US012371290B2

(12) United States Patent
Campbell, Jr.

(10) Patent No.: US 12,371,290 B2
(45) Date of Patent: Jul. 29, 2025

(54) WINDING APPARATUSES, SYSTEMS, AND RELATED METHODS

(71) Applicant: Automated Solutions, LLC, Sawmills, NC (US)

(72) Inventor: Robert L. Campbell, Jr., Hickory, NC (US)

(73) Assignee: Automated Solutions, LLC, Sawmills, NC (US)

( * ) Notice: Subject to any disclaimer, the term of this patent is extended or adjusted under 35 U.S.C. 154(b) by 14 days.

(21) Appl. No.: 18/493,373

(22) Filed: Oct. 24, 2023

(65) Prior Publication Data

US 2024/0051777 A1 Feb. 15, 2024

Related U.S. Application Data

(62) Division of application No. 17/061,260, filed on Oct. 1, 2020, now Pat. No. 11,845,623.

(51) Int. Cl.
*B65H 18/10* (2006.01)

(52) U.S. Cl.
CPC ..... *B65H 18/10* (2013.01); *B65H 2403/92* (2013.01)

(58) Field of Classification Search
CPC ..... B65H 18/10; B65H 18/16; B65H 18/28; B65H 2403/92; B65H 2301/44312; B65H 23/24
See application file for complete search history.

(56) References Cited

U.S. PATENT DOCUMENTS

| | | | | |
|---|---|---|---|---|
| 5,806,284 | A | 9/1998 | Gifford | |
| 8,302,900 | B2 | 11/2012 | Gambini | |
| 9,340,386 | B2 | 5/2016 | Schwamberger et al. | |
| 10,266,359 | B2 * | 4/2019 | Christensen | B65H 19/28 |
| 11,845,623 | B2 * | 12/2023 | Campbell, Jr. | B65H 18/16 |
| 2010/0237179 | A1 | 9/2010 | De Matteis | |

* cited by examiner

*Primary Examiner* — Sang K Kim
(74) *Attorney, Agent, or Firm* — Michael Best & Friedrich LLP

(57) ABSTRACT

Winding apparatuses for winding sheet material and related methods are disclosed herein. The winding apparatuses can include a set of winding drive rollers. Each drive roller of the winding drive rollers can have drive wheels spaced apart along the respective drive roller with a winding zone between the winding drive rollers. The winding apparatus can also include a feed system positioned before the set of the winding drive rollers for moving sheet material along a travel path in a machine direction into the winding zone.

8 Claims, 22 Drawing Sheets

WINDING APPARATUSES, SYSTEMS, AND RELATED METHODS

RELATED APPLICATION

This application is a divisional patent application which claims the benefit of the filing date of U.S. patent application Ser. No. 17/061,260, filed Oct. 1, 2020, the disclosure of which is incorporated herein by reference in its entirety.

TECHNICAL FIELD

The present subject matter relates to winding apparatuses, systems, and related methods. In particular, the present subject matter in some aspects relates to apparatuses and systems that wind sheet material, such as bubble wrap, foam, or paper, into a roll without need of a core substrate on which the sheet material is to be wind.

BACKGROUND

Bubble wrap and foam wrap are often used to wrap precious items to prevent damage during shipment or other transit. Bubble wrap and foam wrap are generally manufactured and rolled onto large rolls. The large rolls are then cut and transferred to smaller rolls for sale and distribution in stores like Home Depot and Lowe's to sell to consumers for their packing their needs. Traditionally, these smaller rolls are formed on a cardboard core to hold the wrap. Similarly, other sheet material has also been manufactured and packaged in a similarly manner.

The only substantial purposes of the cardboard cores for such rolls are to provide a cylindrical surface on which a sheet material can be tightly wrapped to form a roll and, in some instances, to facilitate use of the sheet material by inserting a handling rod through the cardboard core for ease of rotation of the roll when removing the sheet material. To reduce waste and extra cost, there has been a trend to move to a coreless roll, which is a roll that is rolled upon itself without a cardboard core. However, the development of a system to provide a coreless roll of sheet material has proven to be problematic.

Previous coreless winding systems have trouble starting a roll because sheet materials tend to rotate out of the winding area before the roll can start. Further, without having a core roll on which to wind, once the roll is started, it is hard to maintain a proper tension in the roll as the roll is being wound. Without proper tension, the roll tends to become loose which can lead to the roll telescoping by allowing the inner portion of the roll to slide out of the middle of the roll. Once the roll telescopes, the roll can end up collapsing.

As such, a need exists for winding apparatuses, systems, and methods for winding sheet material into a roll that can more effectively start the winding the roll of sheet material and maintain a proper tension to create a tight roll that does not easily collapse on itself.

SUMMARY

The present subject matter provides winding apparatuses, systems, and related methods for winding sheet material into a roll. In particular, the present subject matter, in some aspects, relates to apparatuses and systems that wind sheet material, such as bubble wrap, foam, or paper, into a roll without need of a core substrate on which the sheet material is to be wind. Methods related to the manufacture and use of the coreless winding apparatuses and systems as disclosed herein are also provided.

Thus, it is an object of the presently disclosed subject matter to provide winding apparatuses and winding systems for winding sheet material into a roll as well as methods related thereto. While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1A:
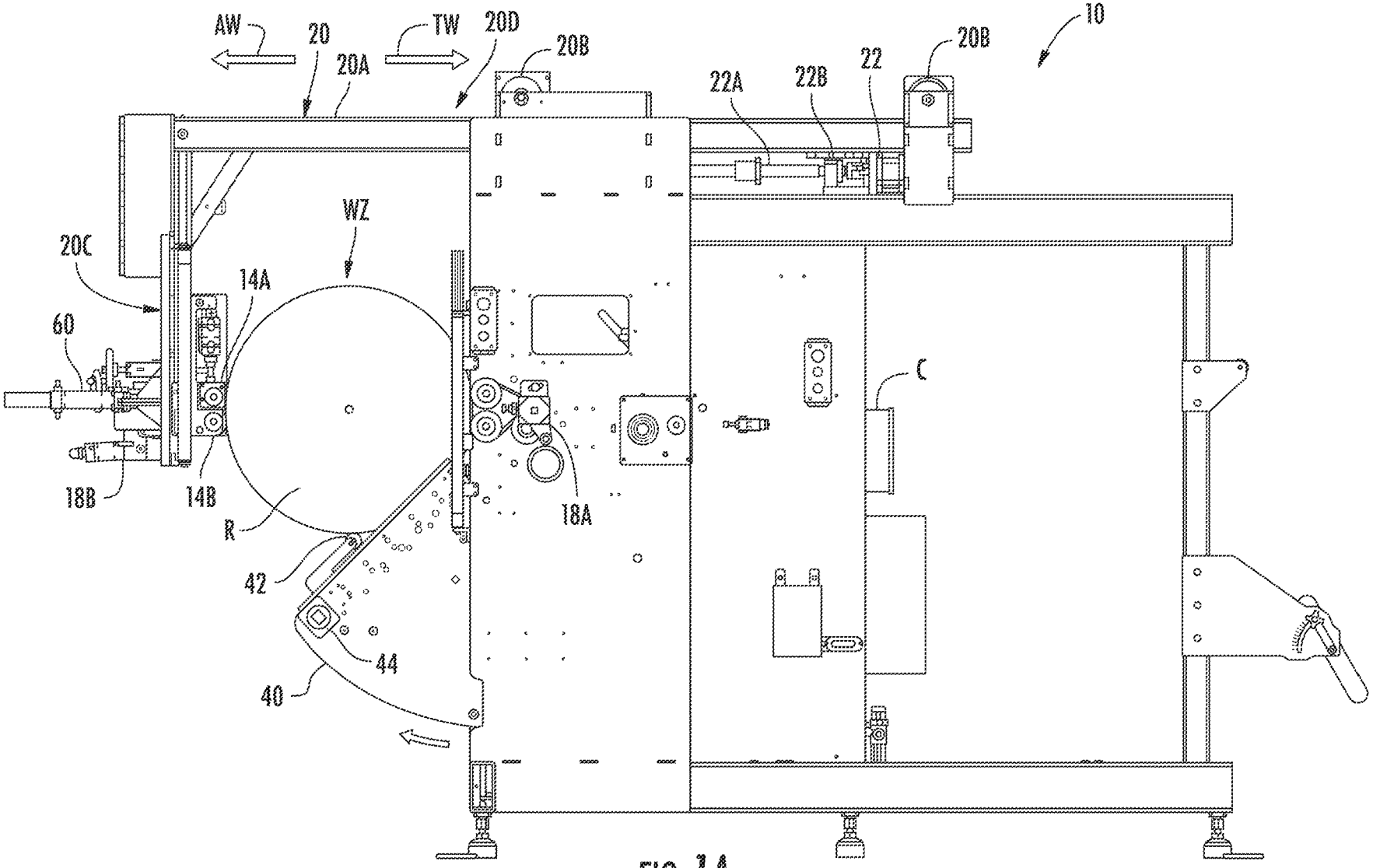
FIG. 1A illustrates a side plan view of an embodiment of a winding apparatus for winding coreless rolls according to the present subject matter.
Figure 1B:
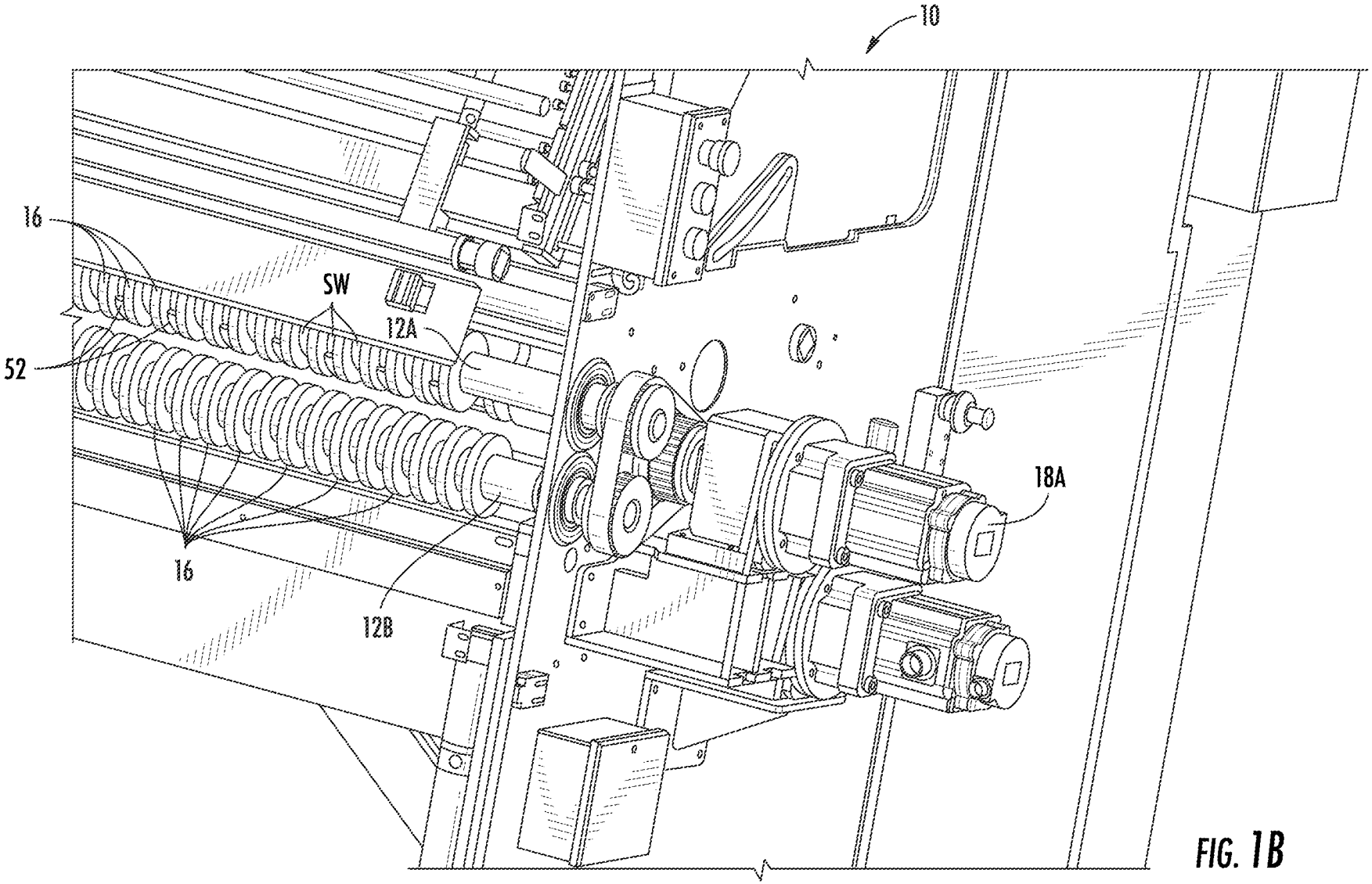
FIG. 1B illustrates a partial perspective view of a portion of a winding apparatus showing upper and lower front drive rollers used to wind sheet material into a roll according to the present subject matter.

Repeat use of reference characters in the present specification and drawings is intended to represent the seam or analogous features or elements of the present subject matter.

DETAILED DESCRIPTION

Reference now will be made to the embodiments of the present subject matter, one or more examples of which are set forth below. Each example is provided by way of an explanation of the present subject matter, not as a limitation. In fact, it will be apparent to those skilled in the art that various modifications and variations can be made in the present subject matter without departing from the scope or spirit of the present subject matter. For instance, features illustrated or described as one embodiment can be used on another embodiment to yield still a further embodiment. Thus, it is intended that the present subject matter cover such modifications and variations as come within the scope of the appended claims and their equivalents. It is to be understood by one of ordinary skill in the art that the present discussion is a description of exemplary embodiments only and is not intended as limiting the broader aspects of the present subject matter, which broader aspects are embodied in exemplary constructions.

Although the terms first, second, right, left, front, back, top, bottom, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

The term "thermoplastic" is used herein to mean any material formed from a polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers and copolymers, polyvinyl chloride, polyvinyl acetate, etc. and copolymers thereof.

"Sheet material" as used herein means generally flat rollable material made from one or more layers of film, foam, and/or paper layers that can be transferred to rolls and can include, but are not limited to, bubble wrap, foam, paper, and thermoplastic film materials, alone or in combination, as well as other such material used in packaging and packaging material.

The present subject matter discloses winding apparatuses, including but not limited to, coreless winders, used to wind sheet material into a roll for handling and storage as well as related methods. Generally, the winding apparatus can comprise a set of winding rollers. For example, in some embodiments, the winding apparatus can have a set of front drive rollers and back drive rollers that can comprise at least one front drive roller and at least one back drive roller. In some embodiments, for instance, the winding apparatus can comprise upper and lower front drive rollers and upper and lower back drive rollers. Each drive roller of the front drive rollers and the back drive rollers can comprise drive wheels spaced apart along the respective drive roll. The set of front drive rollers and back drive rollers form a winding zone between the front drive rollers and back drive rollers. The winding apparatus can also comprise a feed system positioned before the set of the front drive rollers and the back drive rollers for moving sheet material along a travel path in a machine direction into the winding zone between the set of the front drive rollers and the back drive rollers. In some embodiments, the feed system can comprise a conveyor and one or more feed nip rollers that can be positioned above the conveyor that are configured to press against the conveyor under a weight of the feed nip rollers so that the feed nip rollers rotate with the conveyor as the conveyor rotates. In some embodiments, the feed system can comprise one or more sets of opposing nip rollers with the bottom rollers being driven and the upper rollers being rotated as the bottom rollers rotate. The winding apparatus can have other various components that provided unique features.

For example, in some embodiments, the winding apparatus can comprise a tender perforator positioned before the front drive rollers for perforating the sheet material in a cross-machine direction when a roll of sheet material is finished being wound in the winding zone. The sheet material can be moved with the feed system and/or can be pulled by the winding process. In the embodiments where the feed system comprises a conveyor and nip rollers, the conveyor and nip rollers can aid in moving the sheet material into the winding zone between the set of the front drive rollers and the back drive rollers by running the sheet material between the conveyor and the nip rollers. This movement of the sheet material in the feed system is useful in starting of the winding of a roll of sheet material. In some embodiments, the feed system can be run at the beginning to feed the sheet material into the winding zone to start the roll with the nip rollers being raised after the roll of the sheet material is started and growing and then lowered when the roll is in the final stages. The sheet material can be wound into a coreless roll in the winding zone as the set of the front drive rollers and the back drive rollers rotate. The sheet material can be perforated in the cross-machine direction with the tender perforator to create a roll separation perforation in the sheet material. The conveyor can be rotated, which rotates the nip rollers to move the roll separation perforation in the sheet material into the winding zone between the set of the front drive rollers and the back drive rollers. The movement of the feed system, such as the rotation of the conveyor and nip rollers, can be stopped once the perforation in the sheet material is in the winding zone while the set of the front drive rollers and the back drive rollers continue to rotate causing the roll separation perforation in the sheet material to break to separate the roll of sheet material forming a terminal end of the roll of sheet material rolled in the winding zone and forming a starting end of a new roll of the sheet material that resides in the winding zone.

In some embodiments, the winding apparatus can comprise a carriage on which the upper and lower back drive rollers are secured that can move away from and towards the upper and lower front drive rollers to move the upper and lower back drive rollers to widen the winding zone as the roll of sheet material grows. Instead of pivoting outward from a pivot point below the roll, the carriage moves linearly inward and outward to keep the back drive rollers in contact with the roll as it grows. The linear movement of the carriage can also keep the back drive rollers and the front drive rollers in the same opposing position on either side of the roll being wound as the roll grows.

In some embodiments, the winding apparatus can additionally comprise a support cradle that can include a support roller that extends traverse to the travel path of the sheet material and about parallel to the set of front drive rollers and back drive rollers. The support cradle can be moved between a support position and a release position depending on the formation of the roll of sheet material. When in the support position, the support cradle is rotated outward such that support cradle can support a roll of sheet material being wound in the winding zone with the support roller. The support roller can be moved downward at a 45° angle to stay in contact with the roll of sheet material for support as the roll of sheet material grows. Once the roll of sheet material has reached a desired size, the support cradle can be rotated inward to a release position such that the support roller is removed from its supporting position and the roll of sheet material can be released from the winding zone.

In some embodiments, the front drive rollers, the back drive rollers, the carriage, and the feed system can each be controlled by separate servo-motors. In some embodiments, the support roller can also be controlled by a servo motor. Each of the servo motors can be controlled independently of the other servo motors to maintain tightness of the roll of sheet material as the roll of sheet material grows. For example, the servo motors can be controlled independently by a controller that allows each servo motor to operate independent of the other servo motors. The controller can be a computing device that has enough memory and random access memory and a capable processing unit to operate the winding apparatus, and can include, but is not limited to a computer, a mini-computer, a programmable logic controller (PLC), other central processing units, or the like.

By independently controlling the front and back drive rollers, the feed system and the carriage, the tightness of the rolls and tension at various points within the roll can be easily, and changeably, controlled. For large rolls, the tension in the middle becomes greater as the roll grows. By using the servo motors on the front drive rollers, back drive rollers, the conveyor and the carriage, each of these components can be independently adjusted to allow the tension to be easily changed at various points as the roll grows as desired. For example, by independently controlling the speed of the feed system, the speed of the front and back drive rollers, and the speed at which the carriage moves outward with the ability to adjust the speed of the movement of the carriage linearly outward as needed as the diameter of the roll grows, a constant tension throughout the winding process and the roll can be maintained to prevent different portions of the wound roll from being too tight or too loose.

In some embodiments, the winding apparatus can comprise at least one notched circular slitter blade configured to rotate in the machine direction of the travel path to create a lengthwise perforation in the sheet material in the machine direction before the sheet material enters the winding zone between the set of the front drive rollers and the back drive rollers. The at least one notched circular slitter blade can comprise a cutting edge surface around a circumference of the blade with one or more indentures in the cutting edge surface to form isthmuses of sheet material between the perforations formed by the cutting edge surface. Sheet material can be moved with the conveyor into the winding zone between the set of the front drive rollers and the back drive rollers as the sheet material is perforated in the machine direction with at least one notched circular slitter blade to create product roll separation perforations in the sheet material. The sheet material can be wound into a master roll in the winding zone as the set of the front drive rollers and the back drive rollers rotate and separate to widen the winding zone as the roll of sheet material enlarges such that the product roll separation perforations are about normal to an axis of the master roll of the sheet material. The master roll of sheet material can be released from the winding zone once the roll has reached a desired cylindrical circumference and the sheet material being fed to the roll is separated from the roll. Shear forces can be applied to the master roll of sheet material to break the master roll into product rolls of sheet material along the product roll perforations formed by the at least one notched circular slitter blade. Alternatively, in some embodiments, continuous slitter blades or other slitting apparatuses, such as knife blades, can be used to provide continuous slits in the machine direction before the sheet material is fed into the winding zone. In this manner, the individual product rolls will already be formed upon winding without need of breaking the larger wound roll.

In some embodiments, the winding apparatus can comprise air tubes positioned periodically in the spaces between the drive wheels of the upper front drive rollers. The air tubes can be angled to blow air forward and downward into the winding zone to prevent the catching of a start end of the sheet material by the wheels of the upper front roll in a manner that would cause the start end to exit between the upper and lower front drive rollers during the beginning formation of the roll of sheet material. For example, a start end of sheet material can be moved with the feed system in the winding zone between the set of the front drive rollers and the back drive rollers. The wheels on the front and back drive rollers contact the sheet material being fed into the winding zone causing the sheet material to rotate in on itself. Air can be blown into the winding zone to prevent the catching of a start end of the sheet material by the wheels of the upper front roll in a manner that would cause the start end to exit between the upper and lower front drive rollers during the beginning formation of the roll of sheet material. The sheet material can then be wound into the roll of sheet material in the winding zone as the set of the front drive rollers and the back drive rollers rotate and separate to widen the winding zone as the roll of sheet material grows.

The winding apparatus can further comprise fingers that can be positioned in the spaces between the drive wheels of the upper front drive rollers not occupied by the air tubes. The fingers can be angled to cause the start end of the sheet material to roll forward in the rotational direction in which the roll will rotate in the winding zone to form an axis of the roll of the sheet material. Similar to the air tubes, the fingers can aid in preventing the catching of the start end of the sheet material, the fingers can remove contact of the sheet material with the drive wheels of the upper front drive roller to aid in preventing the drive wheels from pulling the start end out of the winding zone. For example, the fingers can extend on an entry side of the drive wheels of the upper front drive rollers and extend in the spaces between the wheels on an underside of the wheels such that a portion of the fingers extend below the underside of the drive wheels. The fingers can be angled in a manner so that the ends of the fingers do not extend beyond a circumference of the drive wheels of the upper front drive rollers.

In some embodiments, the winding apparatus can comprise a welder that can be positioned after the upper and lower back drive rollers. The welder can be inserted between the upper and lower back drive rollers to melt portions of the sheet material proximate to a terminal end of the sheet material to an interior portion of the roll of sheet material to form a weak, releasable weld. To accommodate the insertion of the welder, the upper back drive roller can be moved upward while staying in contact with the circumference of the roll of sheet material to create space between the upper back drive roller and the lower back drive roll. Similarly, in some embodiments, the winding apparatus can comprise a labeler that can be positioned in the same area as the welder after the upper and lower back drive rollers. Like the welder, the labeler can be inserted between the upper and lower back drive rollers to apply a label to a terminal end of the sheet material and a portion of the roll of sheet material to hold the terminal end to the roll of sheet material. As with the welder, the upper back drive roller can move upward while staying in contact with the circumference of the roll of sheet material to create space between the upper back drive roller and the lower back drive roller for insertion of the labeler and to hold the roll in place as the label is applied.

Figure 1E:
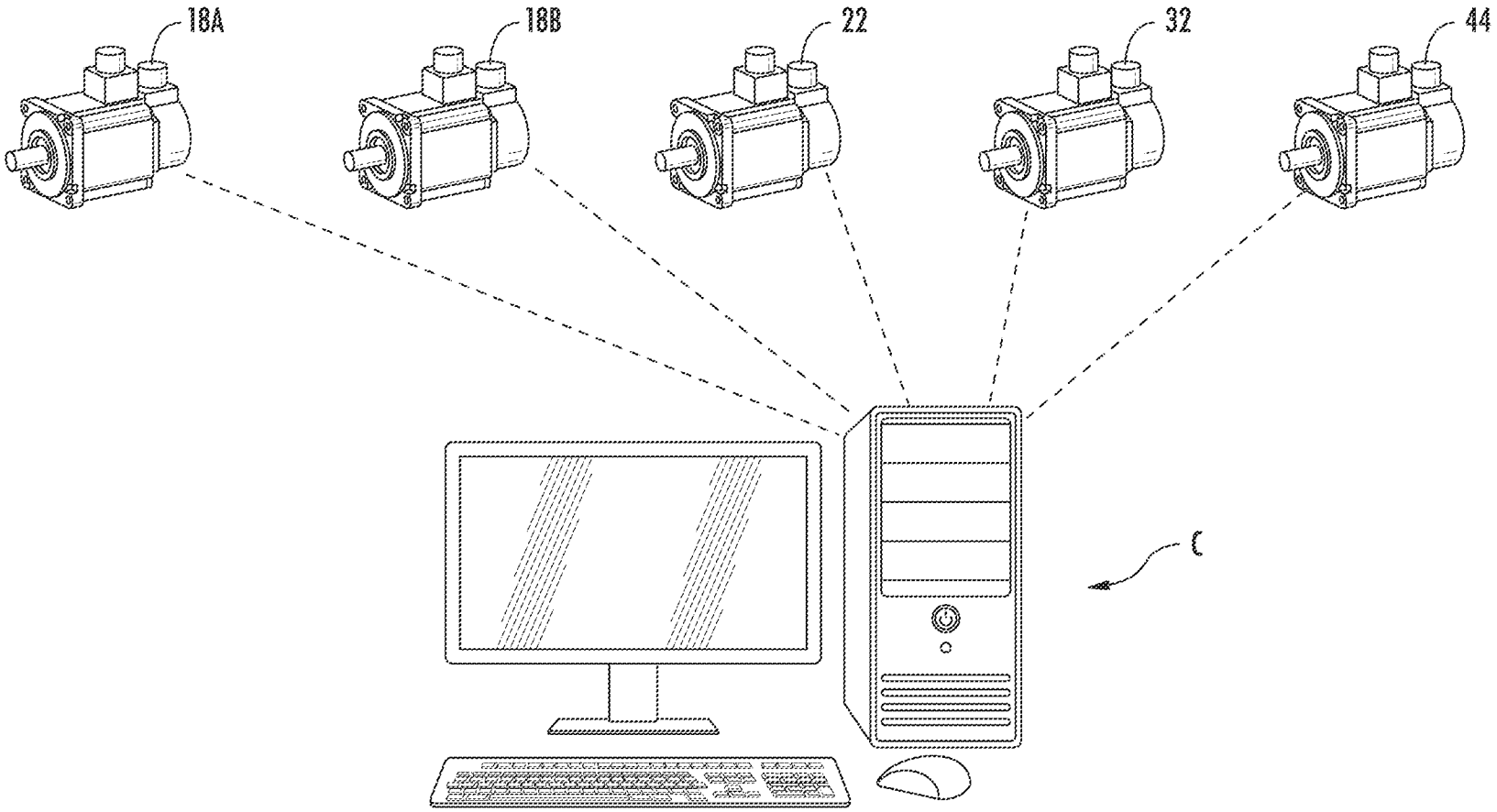
FIG. 1E illustrates a schematic drawing of an embodiment of a controller in communication with servo motors that can be used in an embodiment of a winding apparatus according to the present subject matter.
Figure 2A:
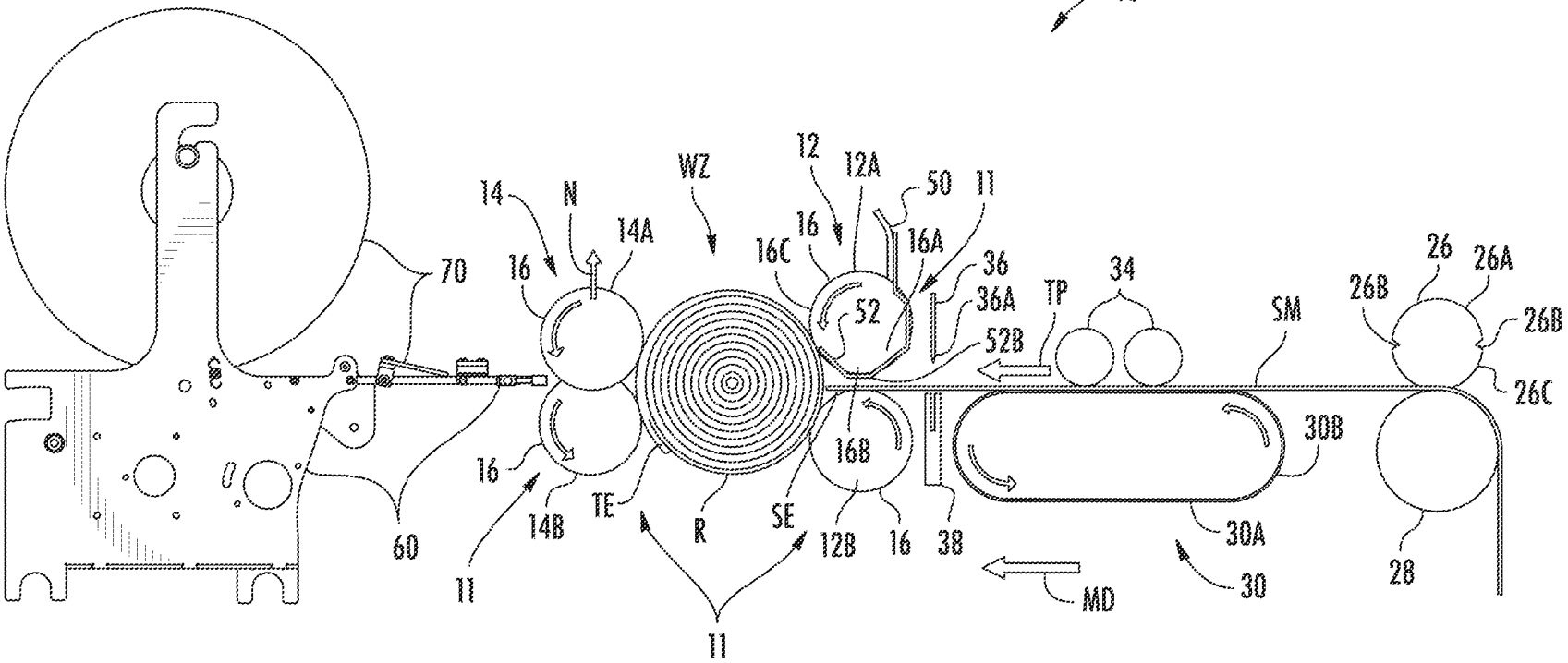
FIG. 2A illustrates a schematic side view of an embodiment of a winding apparatus when a roll is wound according to the present subject matter.
Figure 2B:
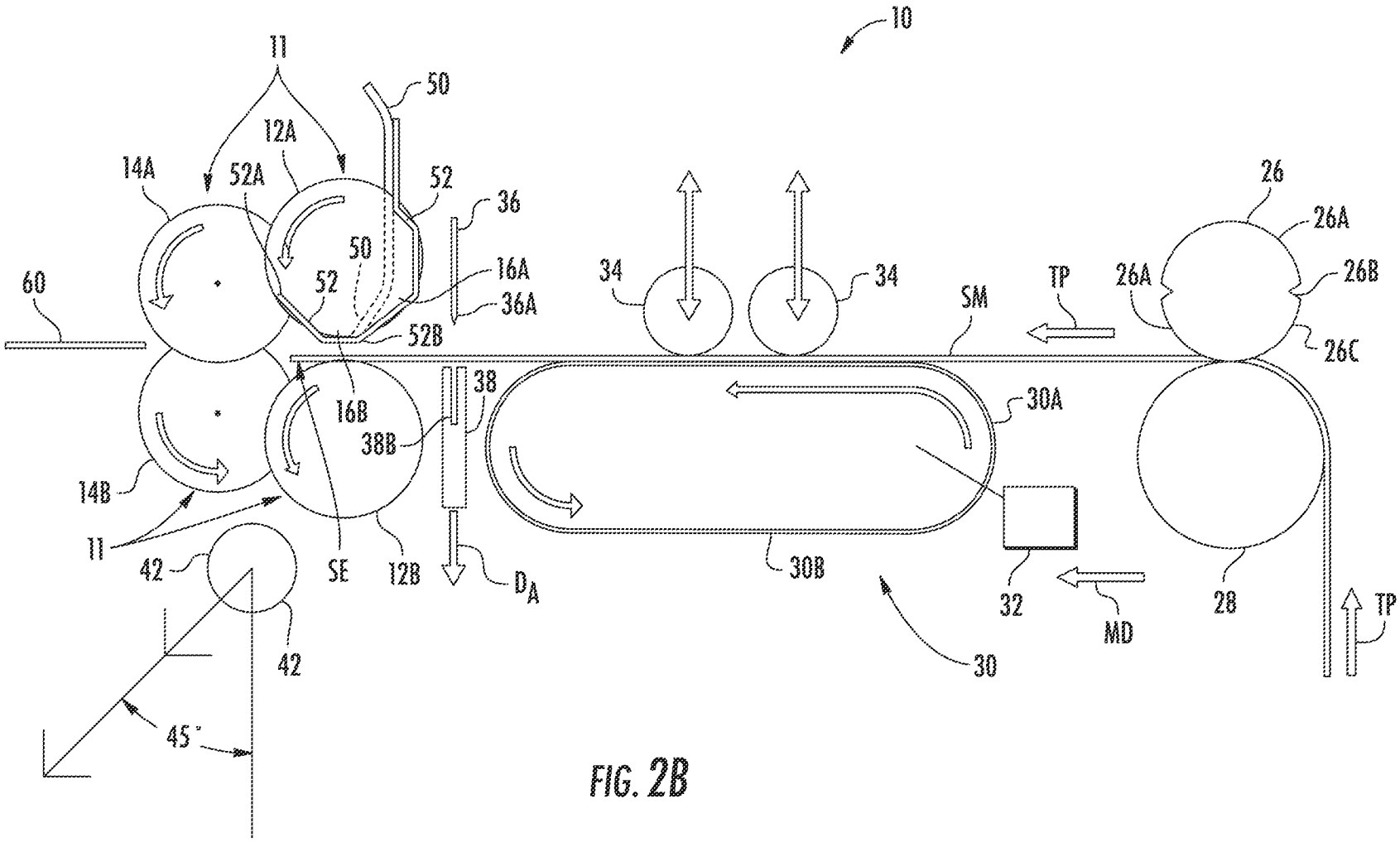
FIG. 2B illustrates a schematic side view of an embodiment of a winding apparatus at the start of a new roll according to the present subject matter.

Referring to FIGS. 1A, 1B, 2A, and 2B, a winding apparatus, generally designated 10, is provided. FIGS. 2A and 2B illustrate a schematic side view representation of the winding apparatus 10. The winding apparatus 10 can be used to wind coreless rolls R though rolls that are wound on cardboard cores can also be wound in the winding apparatus 10. The winding apparatus 10 can comprise a set of winding rollers 11 used to wind sheet material SM into a roll R as shown in FIGS. 2A and 2B. The winding rollers 11 can comprise one or more front rollers 12 and one or more back rollers 14. For example, the winding rollers 11 can comprise upper front drive rollers 12A and lower front drive rollers 12B and upper back drive rollers 14A and lower back drive rollers 14B. Each drive roller of the winding rollers 11, such as, for example, the upper and lower front drive rollers 12A, 12B and the upper and lower back drive rollers 14A, 14B, can comprise drive wheels 16 as more clearly shown in FIG. 1B with reference to upper and lower front drive rollers 12A, 12B spaced apart along the respective drive roller 12A, 12B, 14A, 14B. A winding zone WZ can reside between the front drive rollers 12A, 12B and back drive rollers 14A, 14B in which to wind sheet material SM into a roll R. A front drive roller servo motor 18A can be provided to control the upper and lower front drive rollers 12A, 12B and a back drive roller servo motor 18B can be provided to control the upper and lower back drive rollers 14A, 14B so that the upper and lower front drive rollers 12A, 12B and upper and lower back drive rollers 14A, 14B are independently controlled. The winding apparatus 10 can comprise a controller C that can control the operation of the winding apparatus 10, including the drive roller servo motors 18A and 18B as shown in FIG. 1E as well as other components of the winding apparatus 10 as described below. The controller C can be any number of computing devices as outlined above, including but not limited to one or more computers, mini-computers, programmable logic controllers (PLC), other central processing units, or the like.

The winding apparatus 10 can comprise a carriage, generally designated 20, as shown in FIG. 1A on which the upper and lower back drive rollers 14A, 14B are secured. The carriage 20 can be moved in a direction AW away from and in a direction TW towards the upper and lower front drive rollers 12A, 12B to move the upper and lower back drive rollers 14A, 14B to widen the winding zone WZ as the roll of sheet material R grows and restrict the winding zone WZ once the roll R is dropped and a new roll of sheet material is to be formed. To accomplish this movement, the movement of the carriage 20 can be controlled by carriage servo motor 22.

Figure 8A:
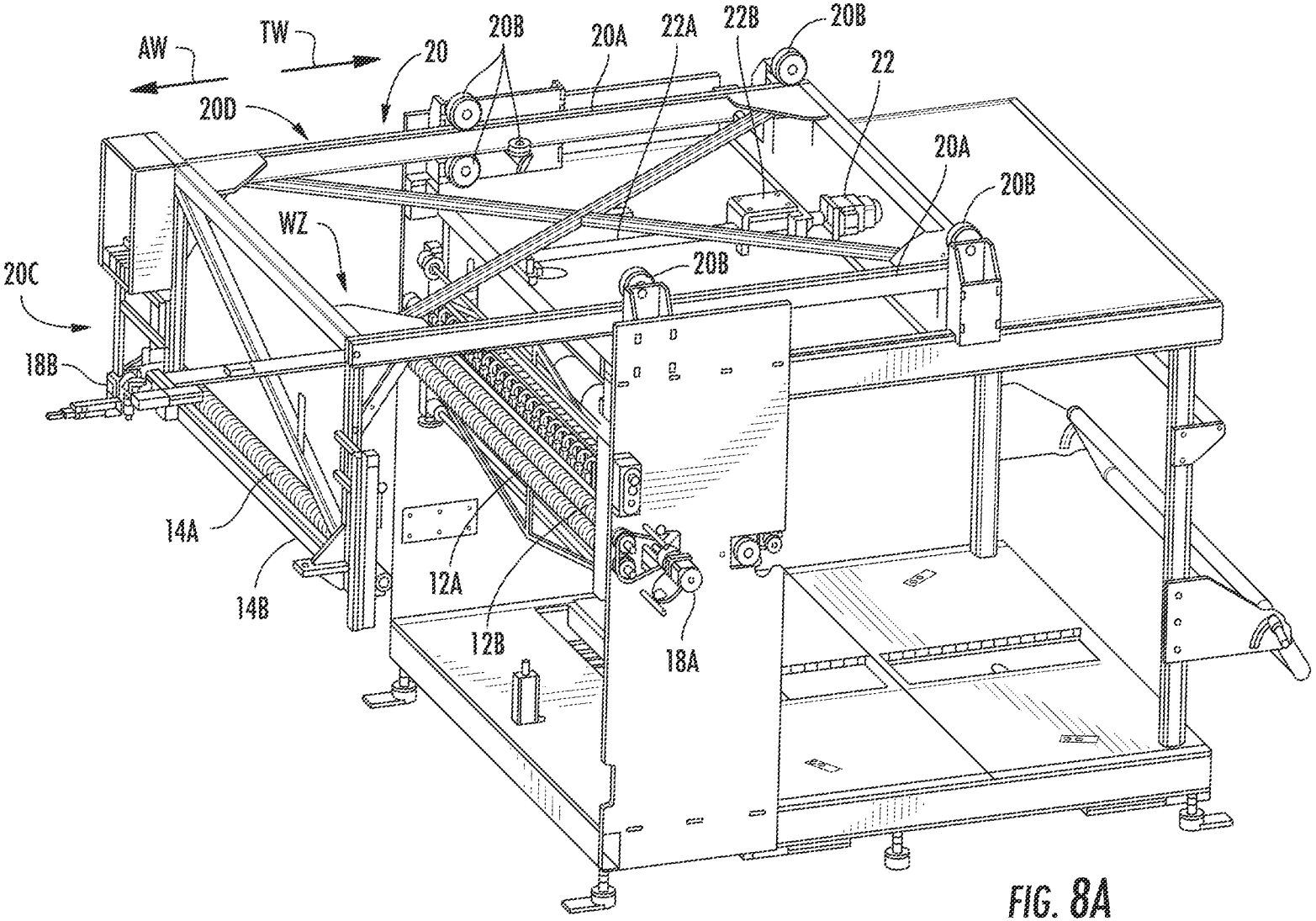
FIG. 8A illustrates a top perspective view of an embodiment of a winding apparatus for winding coreless rolls according to the present subject matter showing an embodiment of a carriage that supports back rollers of the winding apparatus.
Figure 8B:
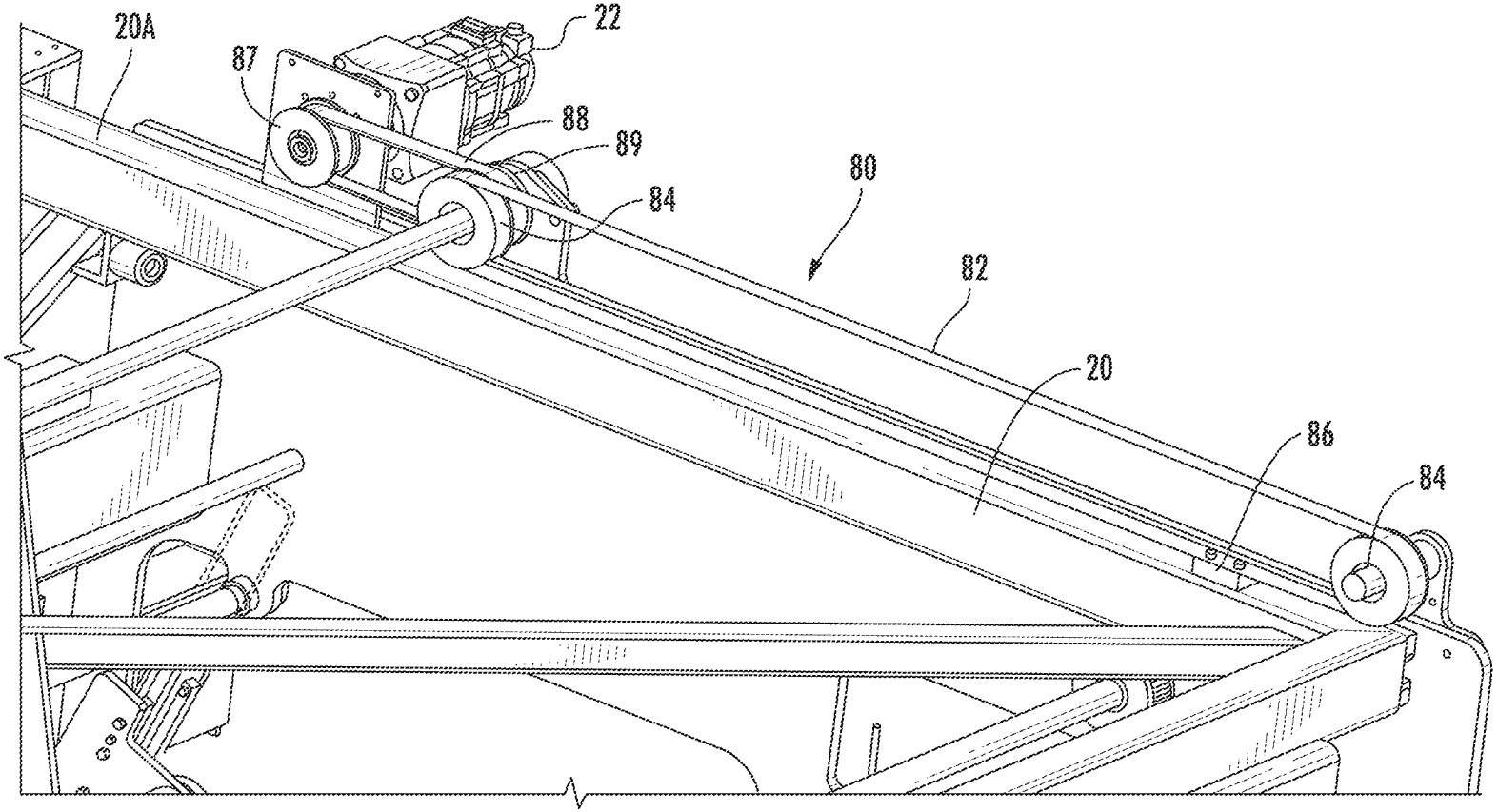
FIG. 8B illustrates a partial perspective view of a portion of a winding apparatus showing an embodiment of a drive system for an embodiment of a carriage that supports back rollers of the winding apparatus according to the present subject matter.

As stated above, the carriage 20 on which the one or more back drive rollers 14A, 14B can reside and that is movable inward and outward in linear directions AW and TW can provide more precise movement of the one or more back drive rollers 14A, 14B to the one or more front drive rollers 12A, 12B than traditional pivoting carriages that pivot from a pivot point in conventional winding apparatuses. This ability to provide a linearly movement of the carriage can provide better control of the tension of a roll R as it grows. The carriage 20 can be configured and driven in different manners. As shown in FIGS. 1A, 8A and 8B, in some embodiments, the carriage 20 can comprise a traversing portion 20D that can include linearly moveable carriage rails 20A and guide wheels 20B that can aid in guiding the carriage rails 20A and in ensure the rails 20A linear movement in the directions AW and TW. In the embodiments shown, the traversing portion 20D of the carriage 20 can have end rails and crossbeams for supports. The sets of guide wheels 20B are spaced apart and can engage carriage rails 20A while allowing the rails 20 to move to hold the rails 20A as the rails 20 move outward and inward. The carriage 20 can also comprise a roller frame 20C on which the one or more back drive rollers 14A, 14B and the drive system for the one or more back drive rollers 14A, 14B can be secured. In some embodiments, as shown, the traversing portion 20D of the carriage including the rails 20A can be positioned above the one or more front drive rollers 12A, 12B. In such embodiments, the roller frame 20C can extend downward from the traversing portion 20D such that the one or more back drive rollers 14A, 14B are aligned with the one or more front drive rollers 12A, 12B.

As shown in FIGS. 1A and 8A, in some embodiments, the carriage 20 can be driven in the linear directions AW and TW with the carriage servo motor 22 engaged with a screw drive 22A. It is noted that in FIGS. 1A and 8A, the traversing portion 20D and the roller frame 20C are shown fully extended. For example, the screw drive 22A can be engaged by a coupling 22B secured to the traversing portion 20D of the carriage 20. As the carriage servo motor 22 rotates the screw drive 22A in a clockwise or counterclockwise direction, the coupling 22B can move in either the direction AW or the direction TW depending on the threading of the screw drive 22A and the coupling 22B. As the coupling 22B moves, the rails 20A move with guidance of the guide wheels 20B and the traversing portion 20D of the carriage 20 move the roller frame 20C inward or outward in the directions AW and TW.

As another example of a drive system that can be used with the carriage 20 as shown in FIG. 8B, the carriage servo motor 22 engaged with a belt drive 80 to drive the carriage 20 in the directions AW and TW. For example, the carriage servo motor 22 can engage a pulley system of the belt drive 80. For instance, the carriage servo motor 22 can engage a pulley 87 that rotates a belt 88 to rotate a pulley 89 that is on the same axle as a pulley 84 and thereby rotates that pulley 84 that turns belt 82 that engages rail 20A with a securement device 86. As the carriage servo motor 22 rotates in a clockwise or counterclockwise direction, the belt 82 is rotated to move the securement device 86 and the rail 20A in either the direction AW or the direction TW depending on the coupling of the carriage servo motor 22 to the belt system 80 and the rotational turn of the carriage servo motor 22.

Figure 1C:
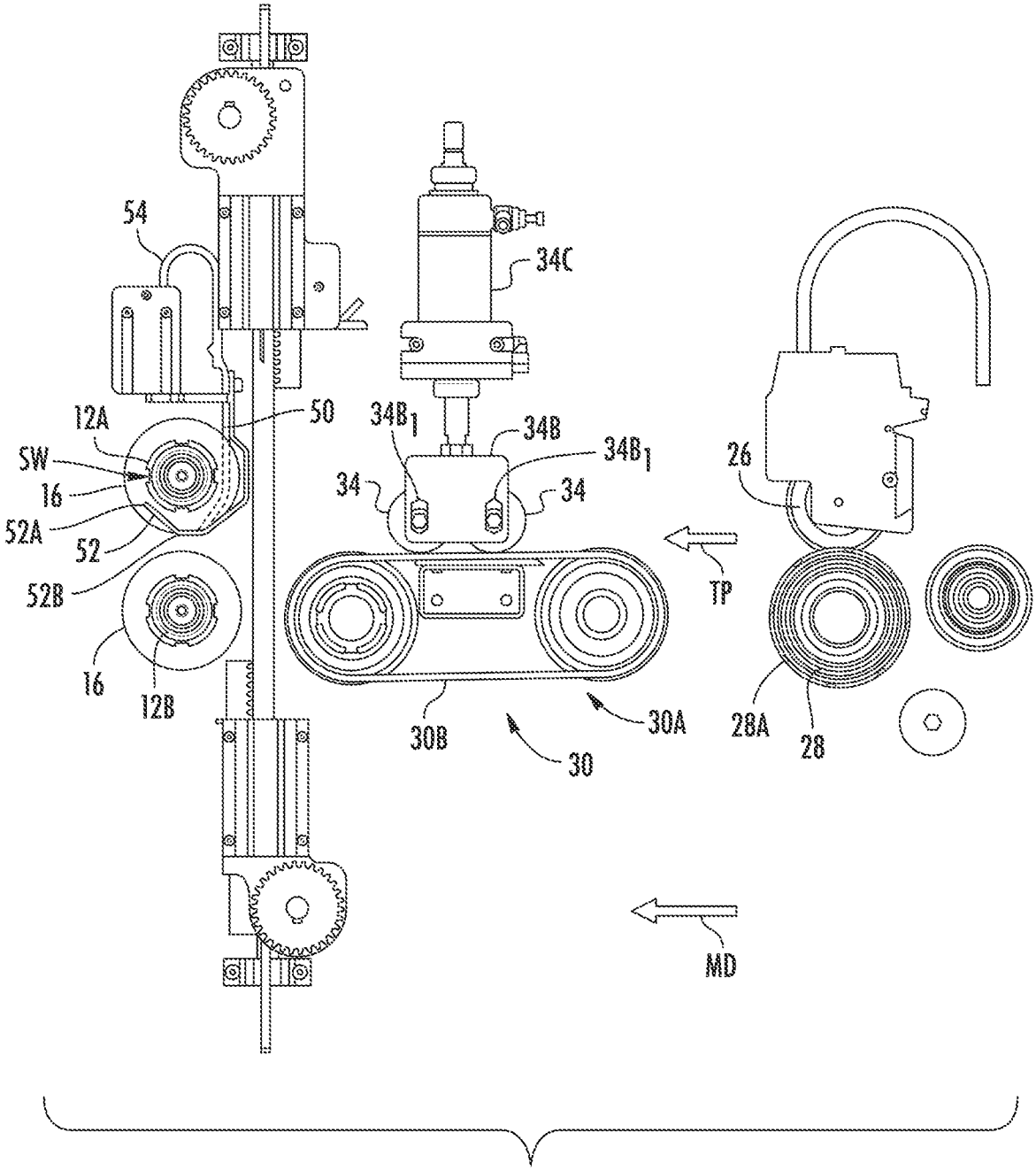
FIG. 1C illustrates a schematic partial cross-sectional right side view of an embodiment of a winding apparatus according to the present subject matter
Figure 1D:
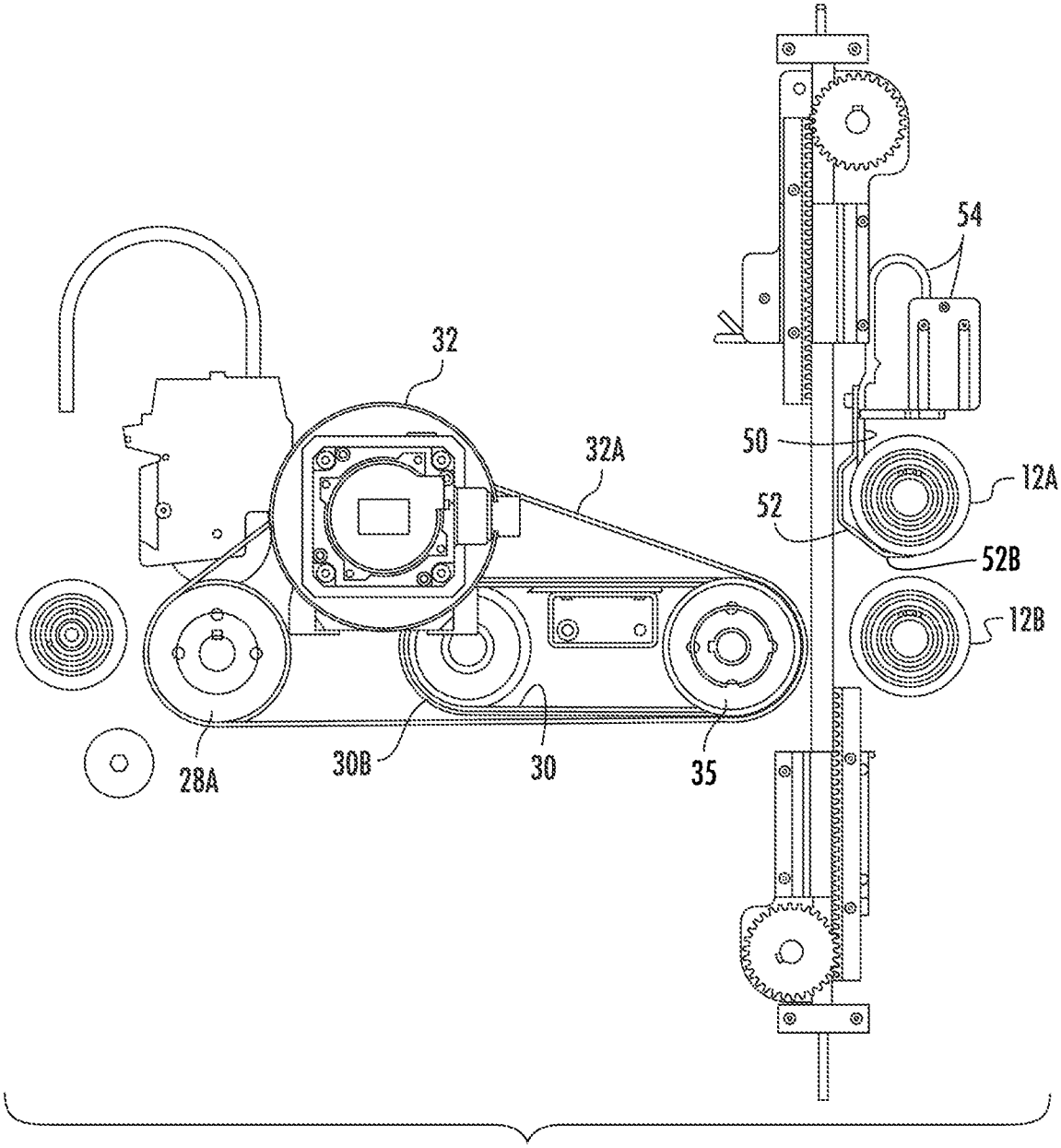
FIG. 1D illustrates a schematic left side view of the embodiment of the winding apparatus according to FIG. 1C showing an embodiment of a servo motor that drives a feed system within the winding apparatus.

The winding apparatus 10 can comprise a feed system 30 positioned as shown in FIGS. 1C, 1D, 2A and 2B before the set of the front drive rollers 12A, 12B and the back drive rollers 14A, 14B which can facilitate movement of sheet material along a travel path TP in a machine direction MD into the winding zone WZ between the set of the front drive rollers 12A, 12B and the back drive rollers 14A, 14B, especially at the beginning of a new roll. A feed system servo motor 32 can control the movement of the feed system 30. As shown in FIG. 1D, in some embodiments, the feed system servo motor 32 can drive a drive belt 32A that can rotate a pulley 35 that is secured to a conveyor roll of the conveyor 30A to rotate the conveyor belt 30B. Similarly, as shown in FIG. 1D, the drive belt 32A can engage a pulley 28A that is secured to a hard roll 28 of the feed system 30 over which the sheet material is feed as described below to rotate the hard roll 28 at the same speed as the conveyor 30A. Alternatively, in some embodiments, the feed system servo motor 32 can be hooked directly to a conveyor roll to rotate the conveyor 30A. In this, manner the speed of the feed system can be controlled by the controller C through the feed system servo motor 32.

Various types of feed systems can be used to move the sheet material into the winding zone. For example, in some embodiments as shown in FIGS. 1C and 1D, the feed system 30 can comprise one or more nip rollers 34 and a conveyor 30A that can comprise a belt 30B. For example, the one or more feed nip rollers 34 can be positioned above the conveyor 30A. The feed nip rollers 34 can be configured to press against the conveyor 30A under the weight of the feed nip rollers 34 so that the nip rollers 34 rotate with the conveyor 30A as the conveyor 30A rotates even when the sheet material SM is running between the conveyor 30A and the nip rollers 34. In some embodiments, the nip rollers 34 can be secured in one or more nip roll plates 34B that can include guide channels 34$B_1$ in which the axles of the nip rollers 34 can float, i.e., independently move up and down, to allow the nip rollers 34 to independently travel over sheet material that can have a diverse topography, such as bubble wrap. The nip roll plates 34B can be secured to a nip roller lift 34C that can be used to raise the nip rollers 34 for feeding the sheet material into the feed system 30 or when the feed system 30 is not needed to drive the sheet material SM into the winding zone WZ. For example, the nip roller lift 34C can comprise a hydraulic or pneumatic cylinder that can be controlled by the controller C.

As shown, the feed system 30 can comprise a tractor drive conveyor 30A driven by the servo motor 32 that can comprise a belt 30B on which the sheet material SM resides when the winding apparatus 10 is forming a roll R and feed nip rollers 34, which can be floating nip rollers, that can aid in transferring the sheet material SM to the winding zone WZ between the front drive rollers 12A, 12B and the back drive rollers 14A, 14B, in particular, at the start of the winding of a new roll.

In some other embodiments, the feed system can comprise one or more sets of opposing nip rollers (not shown) that rotate to move the sheet material SM forward toward the winding zone WZ, for the example, at the beginning and end of the winding of the roll in some embodiments. For example, in such embodiments, the lower nip rollers can be driven, for example, by a servo motor. The upper nip rollers can rest against the lower driven rollers (indirectly when sheet material is running between the nip rollers) and will rotate as the lower nip rollers rotate. The upper nip rollers can float by having vertically moving axes that allow the upper nip rollers to move up and down under their own weight as the topography of the sheet material running underneath the upper rollers changes.

In some embodiments, the winding apparatus 10 can also comprise a tender perforator 36 positioned before the front drive rollers 12A, 12B and the feed system 30 for perforating the sheet material SM in a cross-machine direction CD (see FIG. 2C) when a roll of sheet material R is finished being wound in the winding zone WZ as well be explained further below. In some embodiments, the tender perforator 36 can be between the feed system and the winding drive rollers 12A, 12B, 14A, 14B as shown in FIGS. 1C-3F.

Additionally, the winding apparatus 10 can comprise a support cradle 40 comprising a support roller 42 that extends transverse to the travel path TP of the sheet material SM and about parallel to the set of front drive rollers 12A, 12B and back drive rollers 14A, 14B. For example, the support roller 42 can extend about perpendicular to the travel path TP of the sheet material SM. In some embodiments, the movement of the support cradle 40 can be controlled by an air cylinder (not shown). The support cradle 40 can be moved between a support position, for example, as shown in FIG. 1A, and a release position depending on the formation of the roll of sheet material R. When in the support position, the support cradle 40 has rotated outward such that support cradle 40 can support the roll of sheet material R being wound in the winding zone WZ with the support roller 42 positioned under the roll R. The support roller 42 can be moved downward to stay in contact with the roll of sheet material R for support as the roll of sheet material R grows. In particular, the support roller 42 can be movably controlled by a support roller servo motor 44 such that the support roller 42 comes in contact with the roll of sheet material R and moves downward at about a 45° angle to stay in contact with the roll of sheet material R for support as the roll of sheet material R grows. Thus, as the roll R grows, the support cradle 40 rotates outward and the support roller 42 moves downward to remain under the roll of sheet material R. Once the roll of sheet material R has reached a desired size, the support cradle 40 can be rotated inward to a release position such that the support roller 42 is removed from its supporting position and the roll of sheet material R can be released from the winding zone WZ. The support cradle 40 can be useful in combination with the linearly movable carriage 20 to provide extra support as the roll R grows.

As shown in the schematic drawing of FIG. 1E, each of the front drive roller servo motor 18A, the back drive roller servo motor 18B, the carriage servo motor 22, the conveyor servo motor 32 can be controlled independently of each other by the controller C to maintain tightness of the roll of sheet material R as the roll R grows. By independently controlling the front and back drive rollers 12A, 12B, 14A, 14B, the feed system 30 and the carriage 20, the tightness of the rolls and tension at various points within the roll can be easily, and changeably, controlled. For large rolls R, the tension in the middle becomes greater as the roll grows. By using the servo motors on the front drive rollers, back drive rollers, the conveyor and the carriage, each of these components can be independently adjusted to allow the tension to be easily changed at various points as the roll grows as desired. For example, by independently controlling the speed of the feed system 30, the speed of the front and back drive rollers 12A, 12B, 14A, 14B, and the speed at which the carriage 20 moves outward as needed as the diameter of the roll grows, a constant tension throughout the winding process and the roll R can be maintained to prevent different portions of the wound roll R from being too tight or too loose. In some embodiments that also comprise a support cradle 40, the support roll servo motor 44 can also be independently controlled by controller C as shown in FIG. 1E.

More particularly, for some embodiments, to separate the finished roll from the sheet material, a winding apparatus 10 can be provided that comprises a set of front drive rollers 12A, 12B and back drive rollers 14A, 14B and a feed system 30 as set forth above for moving sheet material along a travel path TP in a machine direction MD into the winding zone WZ between the set of the front drive rollers 12A, 12B and the back drive rollers 14A, 14B and rolling the sheet material SM into a roll R using the front drive rollers 12A, 12B and back drive rollers 14A, 14B.

Figure 2C:
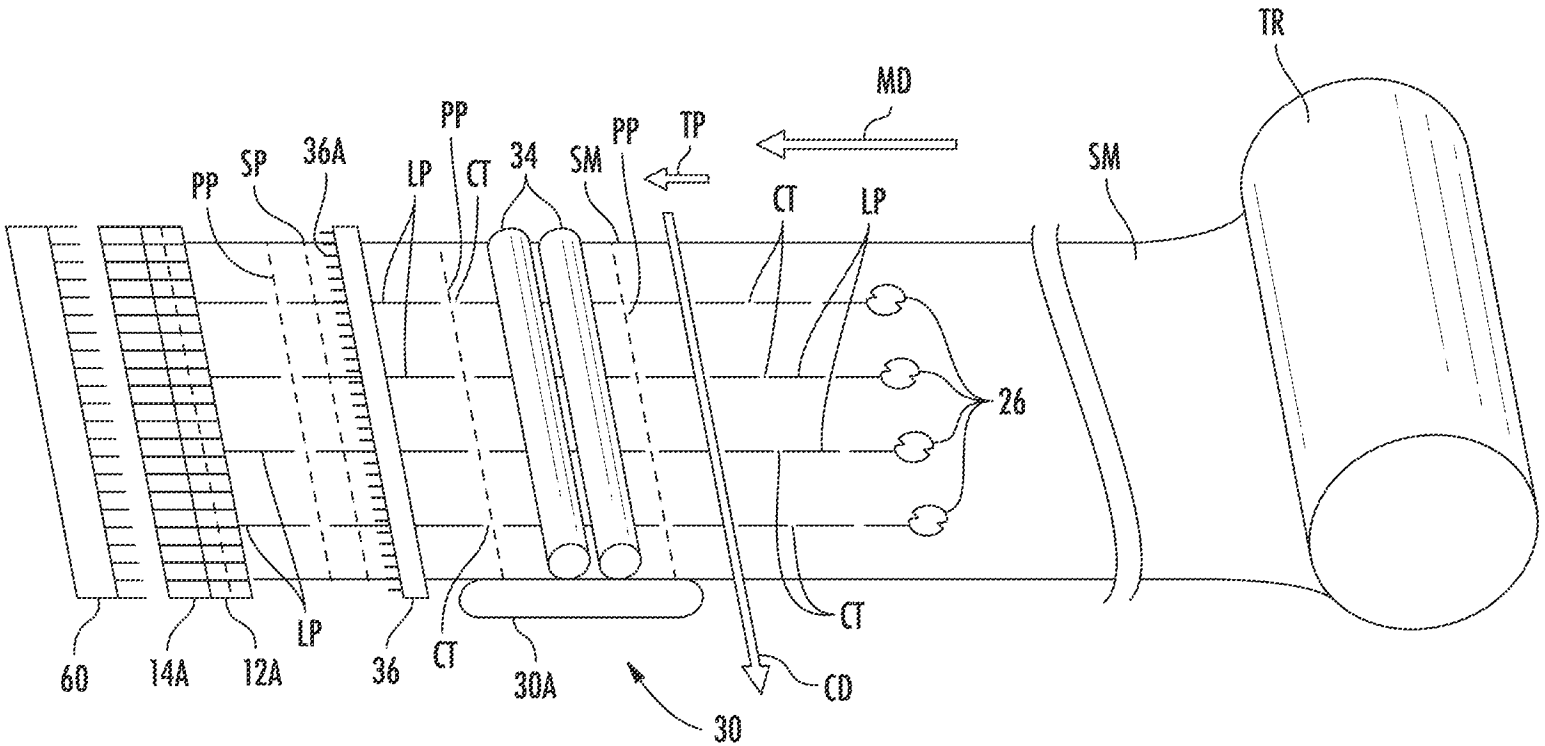
FIG. 2C illustrates a schematic top perspective view showing an embodiment of a winding process using a winding apparatus according to the present subject matter.

As shown in FIGS. 2A-2C and 3A-3F, the winding apparatus 10 can also comprise the tender perforator 36 mentioned above positioned before the front drive rollers 12A, 12B for perforating the sheet material SM in a cross-machine direction CD when a roll of sheet material R is finished being wound in the winding zone WZ. The tender perforator 36 can have spaced apart tines 36A that can pierce the sheet material SM to create a perforation line across the sheet material SM in the cross-machine direction CD. In some such embodiments, the winding apparatus 10 can further comprise a perforator anvil 38. The perforator anvil 38 can have a tine groove 38B therein configured to receive tines 36A of the tender perforator 36 upon insertion of the tines 36A through the sheet material SM to create a roll separation perforation SP as shown in FIG. 2C. For example, in some embodiments when it is desired to complete the end of the roll R, the tender perforator 36 can be moved downward toward the sheet material SM as the tines 36A pierce the sheet material SM, the tines 36A can entered the tine groove 38B of the anvil 38 which receives the tines 36A of the tender perforator 36. As needed, the anvil 38 can be moved downward as indicated in FIG. 2B to facilitate cleaning the anvil 38 and tine groove 38B. For example, after perforation of the sheet material SM by the tender perforator 36, the perforator anvil 38 can be lowered in a direction DA from a working position where the perforator anvil 38 is ready to receive the tines 36A of the tender perforator 36 to a clearing position where tine groove 38A in the perforator anvil 38 is accessible to clear sheet material jams that may be caused by the tender perforator 36.

Referring to FIGS. 2C, and 3A-3F, an embodiment of a process to form a roll R and a winding apparatus 10 can be described. In some embodiments, sheet material SM wound in the winding apparatus 10 can be transferred from a bulk transfer roll TR. In some embodiments, the winding apparatus 10 can be positioned at the end of a sheet material forming system such that the winding apparatus forms rolls directly for consumption by consumers as the sheet material is formed. As shown in the schematic drawing of FIG. 2C, the sheet material SM wound in the winding apparatus can be transferred from a bulk transfer roll TR. Sheet material SM from the bulk transfer roll TR can be moved with the conveyor 30A and nip rollers 34 into the winding zone WZ between the set of the front drive rollers 12A, 12B and the back drive rollers 14A, 14B by running the sheet material SM between the conveyor 30A and the nip rollers 34 and rotating the conveyor 30A in the forward machine direction MD.

Figure 3A:
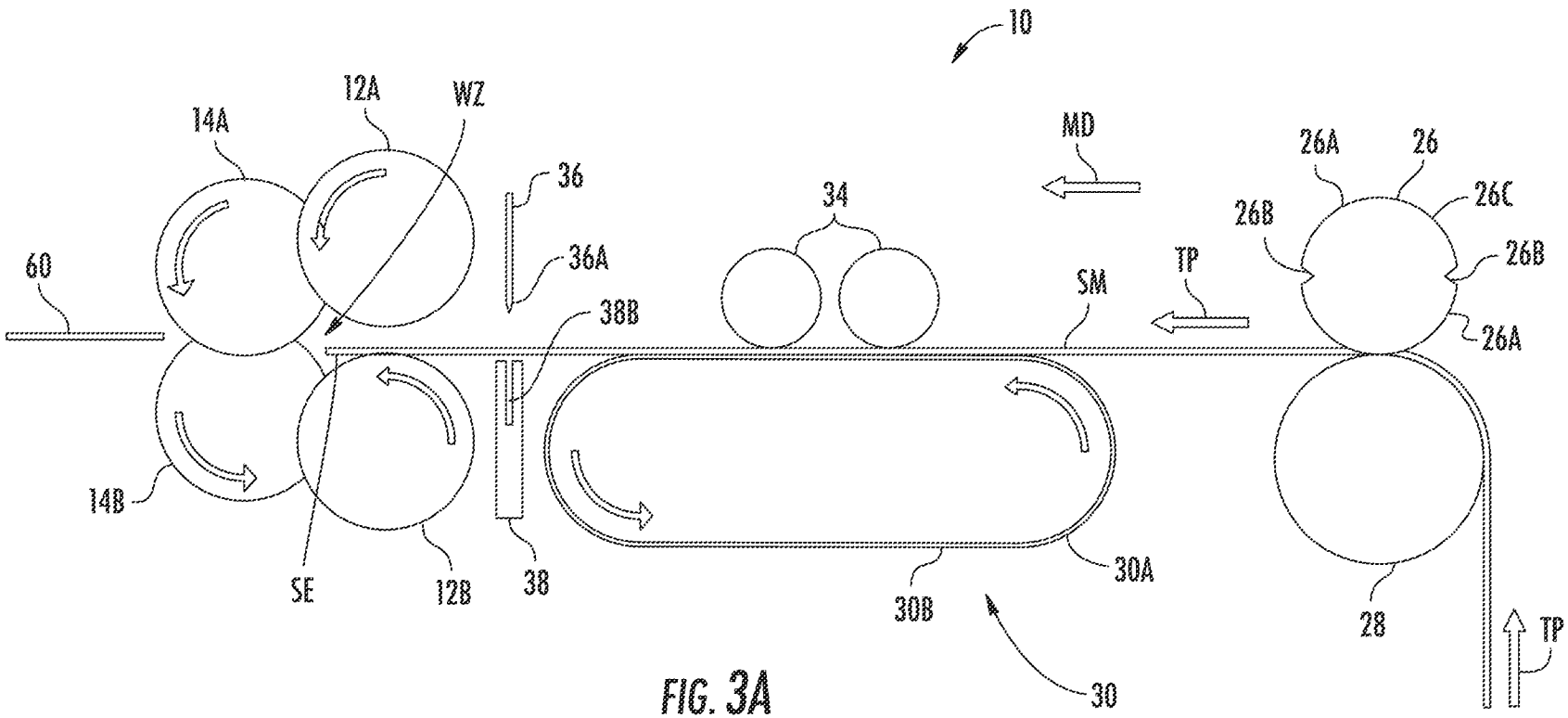
FIG. 3A-3F illustrate schematic side views of an embodiment of a winding apparatus at different stages of the winding process according to the present subject matter.

As shown in FIG. 3A, a start end SE of the sheet material resides in the winding zone WZ to begin the formation of a roll of sheet material R. The carriage 20 as shown in FIG. 1A has moved the back drive rollers 14A, 14B in the direction TW into close proximity with the front drive rollers 12A, 12B to restrict the winding zone WZ to a small space. To begin a new roll of sheet material, the front and back drive rollers 12A, 12B, 14A, 14B can be in a position where they overlap as shown in FIG. 2B, with a gap between the upper front roller 12A and the lower front roller 12B through which the sheet material SM can be fed into the winding zone WZ. This overlapping can be accomplished by offsetting the drive wheels 16 on the respect front and back drive rollers 12A, 12B, 14A, 14B to permit the drive wheels 16 to overlap. The front drive rollers 12A, 12B and back drive rollers 14A, 14B rotate in a direction K as the feed system 30 feeds the sheet material SM further into the winding zone where the start end SE contacts the back drive rollers 14A, 14B causing the start end of the sheet material SM to curl upward as the back drive rollers 14A, 14B rotate in a direction K. As the start end SE of the sheet material SM moves upward it encounters upper back drive roller 14A and the upper front drive roller 12A which directs the start end SE of the sheet material SM back toward the sheet material being driven into the winding zone WZ to cause the start end SE of the sheet material SM to rotate forward in the direction of rotation of the newly forming roll and downward to start the roll R as shown in FIG. 3B.

Figure 3B:
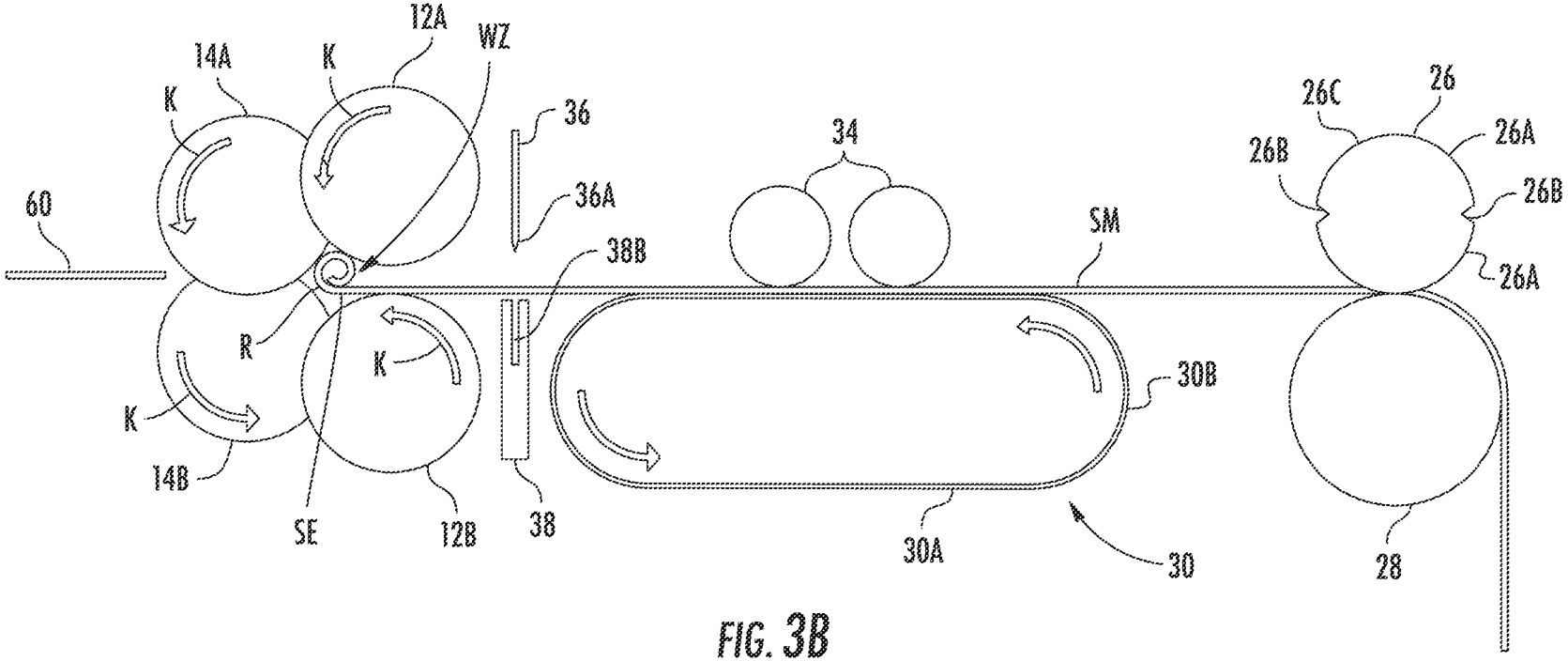
Figure 3C:
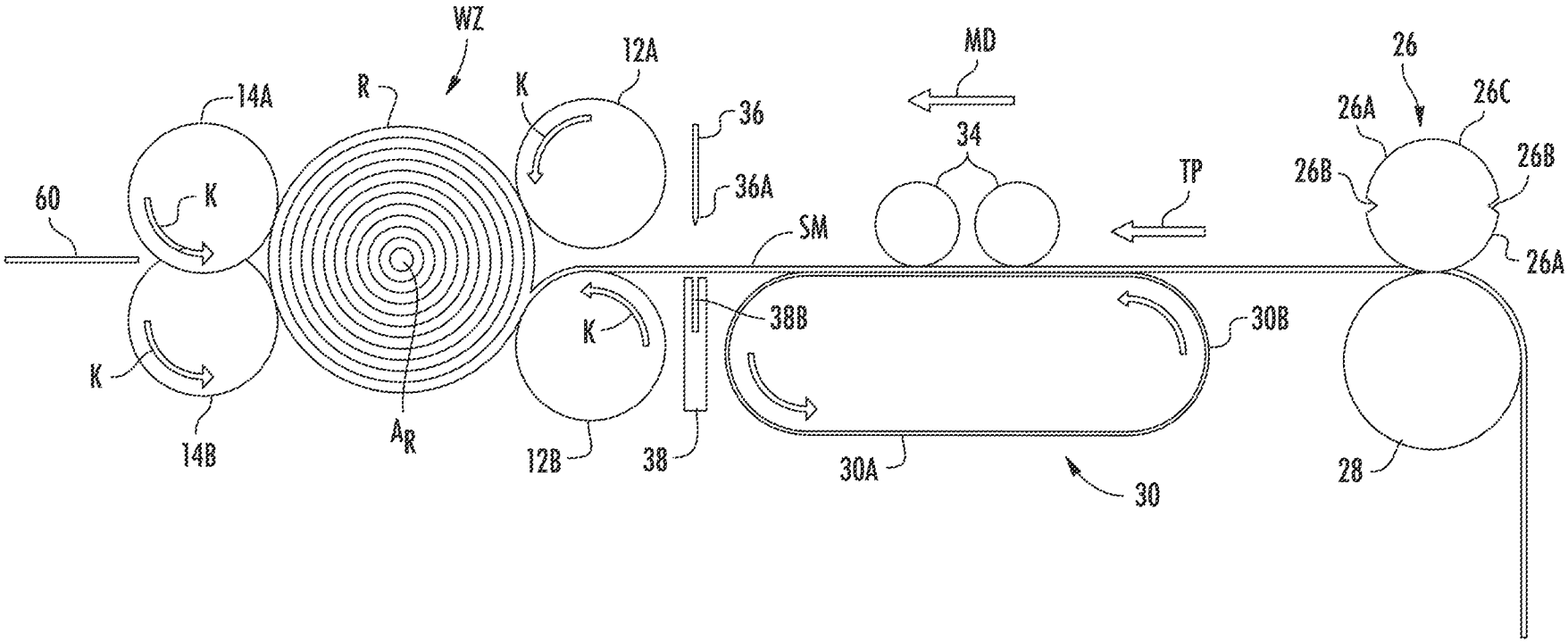
Figure 3D:
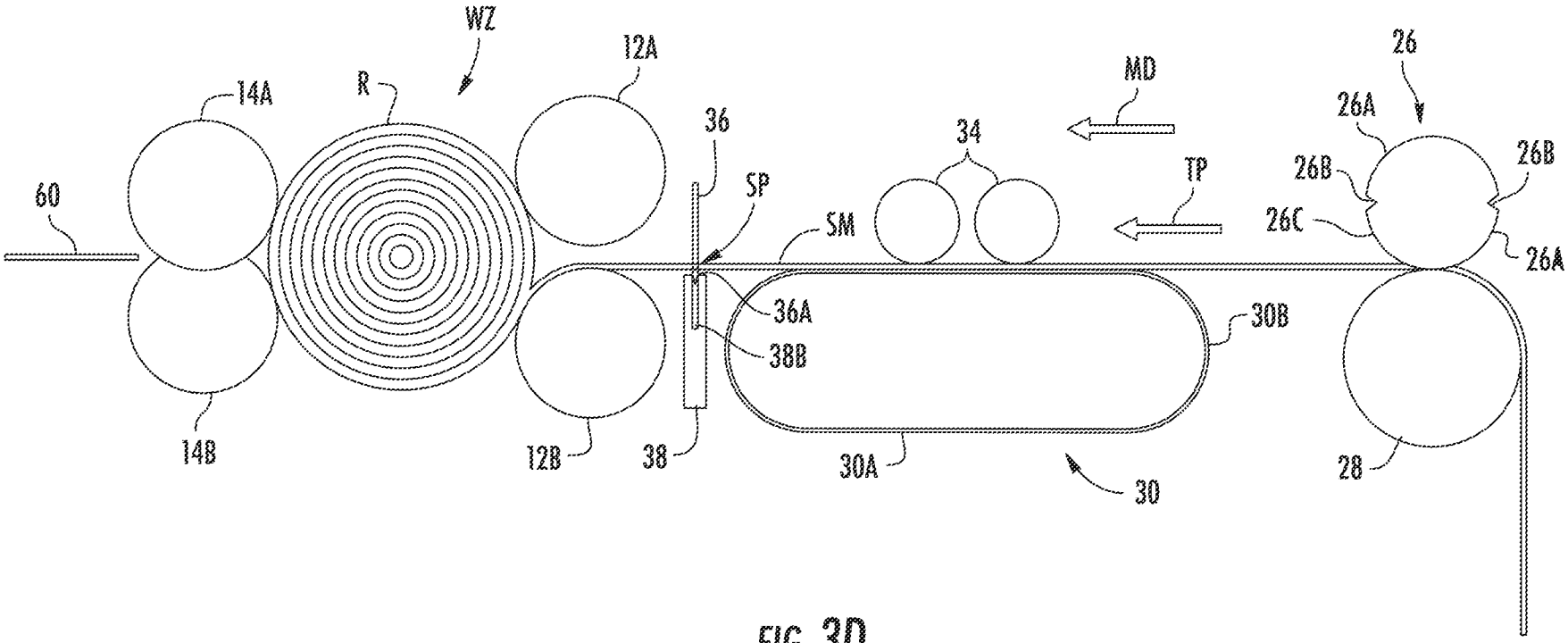
Figure 3E:
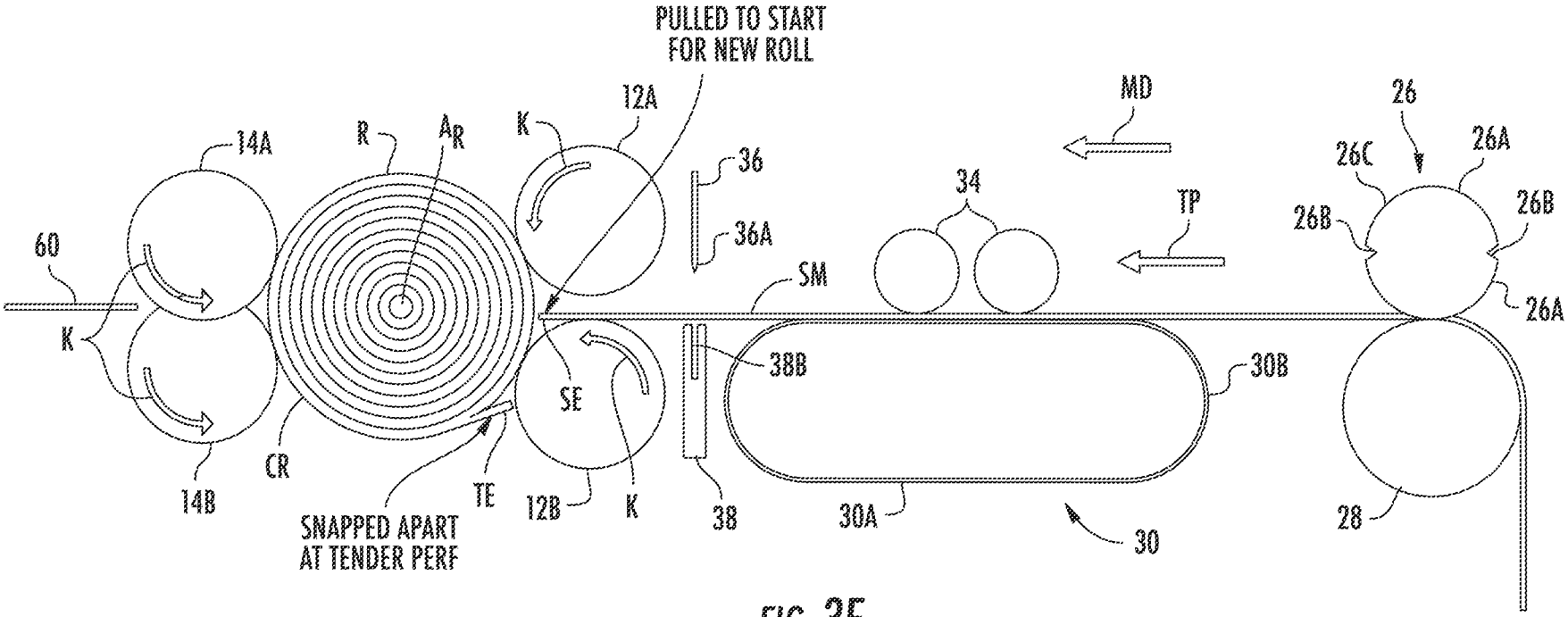

As shown in FIG. 3C, the sheet material SM can then be wound into a coreless roll R in the winding zone WZ as the set of the front drive rollers 12A, 12B and the back drive rollers 14A, 14B rotate. When the roll R reaches the desired size, the winding drive rollers 12A, 12B, 14A, 14B and the feed system 30 can be stopped and the sheet material SM can be perforated in the cross-machine direction CD with the tender perforator 36 to create the roll separation perforation SP in the sheet material SM as shown in FIG. 3D. After perforation, the winding drive rollers 12A, 12B, 14A, 14B and the feed system 30 can be slowly run to move the roll separation perforation SP into the winding zone WZ. For example, the winding drive rollers 12A, 12B, 14A, 14B and the conveyor 30A can be slowly rotated, which, in turn, rotates the feed nip rollers 34 such that the conveyor 30A and the break nip rollers 34 move the roll separation perforation SP in the sheet material SM into the winding zone WZ between the set of the front drive rollers 12A, 12B and the back drive rollers 14A, 14B as the winding drive rollers 12A, 12B, 14A, 14B rotate the roll R. Once the separation perforation SP in the sheet material SM is in the winding zone WZ, the feed system 30 can be stopped. For example, the rotation of the conveyor 30A and the feed nip rollers 34 can be stopped while the set of the front drive rollers 12A, 12B and the back drive rollers 14A, 14B continue to rotate in a direction K. The continued rotation of the roll R while the conveyor 30A is stopped causes the sheet material SM to break along the roll separation perforation SP as shown in FIG. 3E. The roll of sheet material R in the winding zone WZ is separated from the sheet material SM being fed into the winding zone WZ. Thereby, a terminal end TE of the roll of sheet material R is formed and a new starting end SE of a new roll of the sheet material is formed in the winding zone WZ.

Figure 3F:
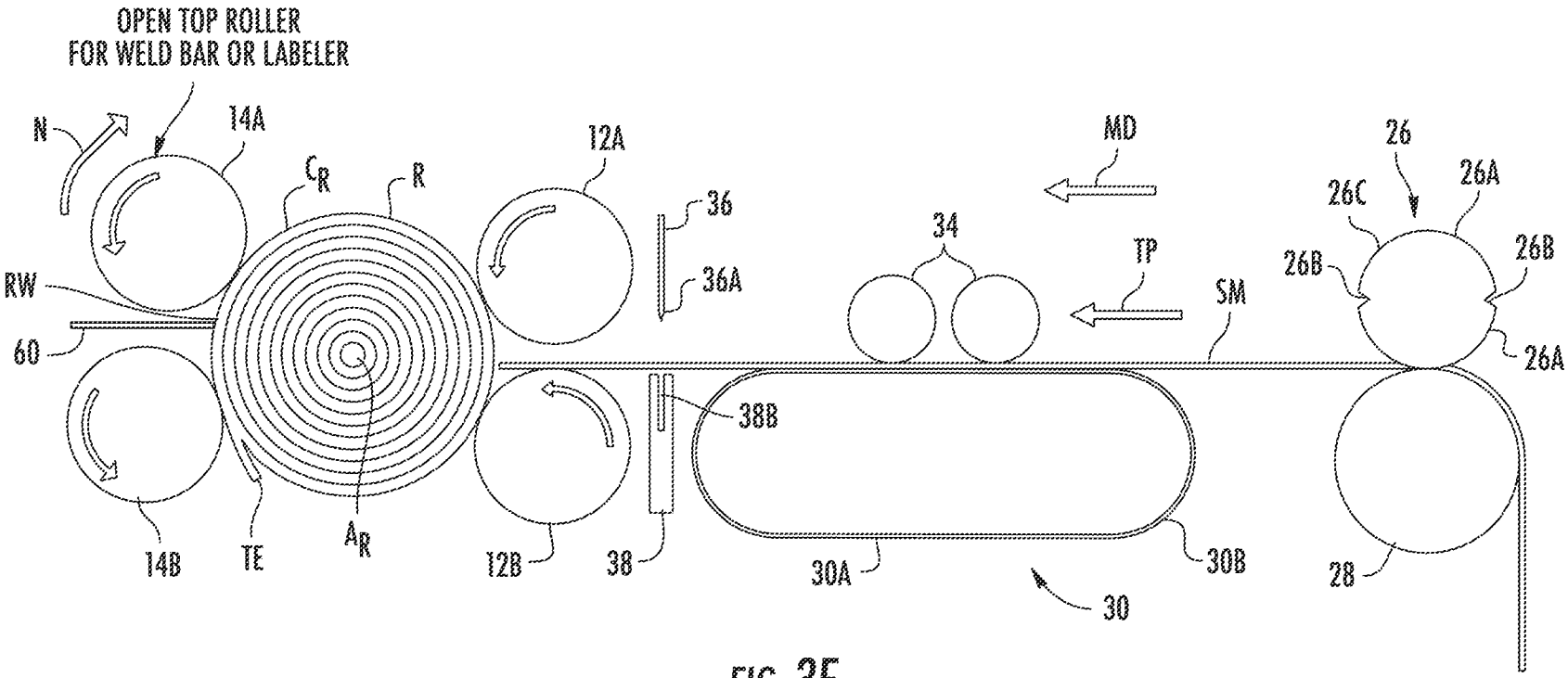

In some embodiments, the winding apparatus 10 can comprise a welder 60 to weld the terminal end TE of the roll of sheet material R to the roll R as shown in FIGS. 1A, 2A, 3A-3F and 9A-9B. The welder 60 can be positioned after the upper and lower back drive rollers 14A, 14B for insertion between the upper and lower back drive rollers 14A, 14B to form a weak, releasable weld RW in a roll of sheet material R. For example, the sheet material SM can be moved with the feed system 30 into the winding zone WZ between the set of the front drive rollers 12A, 12B and the back drive rollers 14A, 14B, such that the sheet material SM can be wound into a coreless roll R in the winding zone WZ as the set of the front drive rollers 12A, 12B and the back drive rollers 14A, 14B rotate and separate to widen the winding zone WZ as the roll of sheet material R grows as shown in FIGS. 3A-3C. After the roll of sheet material R reaches a desired size, such as a desired circumference, diameter, or weight, a terminal end TE of sheet material SM in the roll R can be formed as shown in FIGS. 3D and 3E. The terminal end TE of the sheet material SM in the roll R can then be rotated to a desired position within the winding zone WZ by rotating the front drive rollers 12A, 12B and the back drive rollers 14A, 14B. For example, in some embodiments, the terminal end TE can be rotated to a position proximate to and below where the lower back drive roller 14B contacts the roll R. As shown in FIG. 3F, the upper back drive roller 14A can be raised upward in a direction N while keeping the upper back drive roller 14A in contact with a circumference CR of the roll of sheet material R to create space between the upper back drive roller 14A and the lower back drive roller 14B. The welder 60 can then be inserted between the upper and lower back drive rollers 14A, 14B as shown in FIG. 3F to melt portions of the sheet material SM proximate to the terminal end TE to an interior portion of the roll of sheet material R to form a releasable weld RW.

Figure 9A:
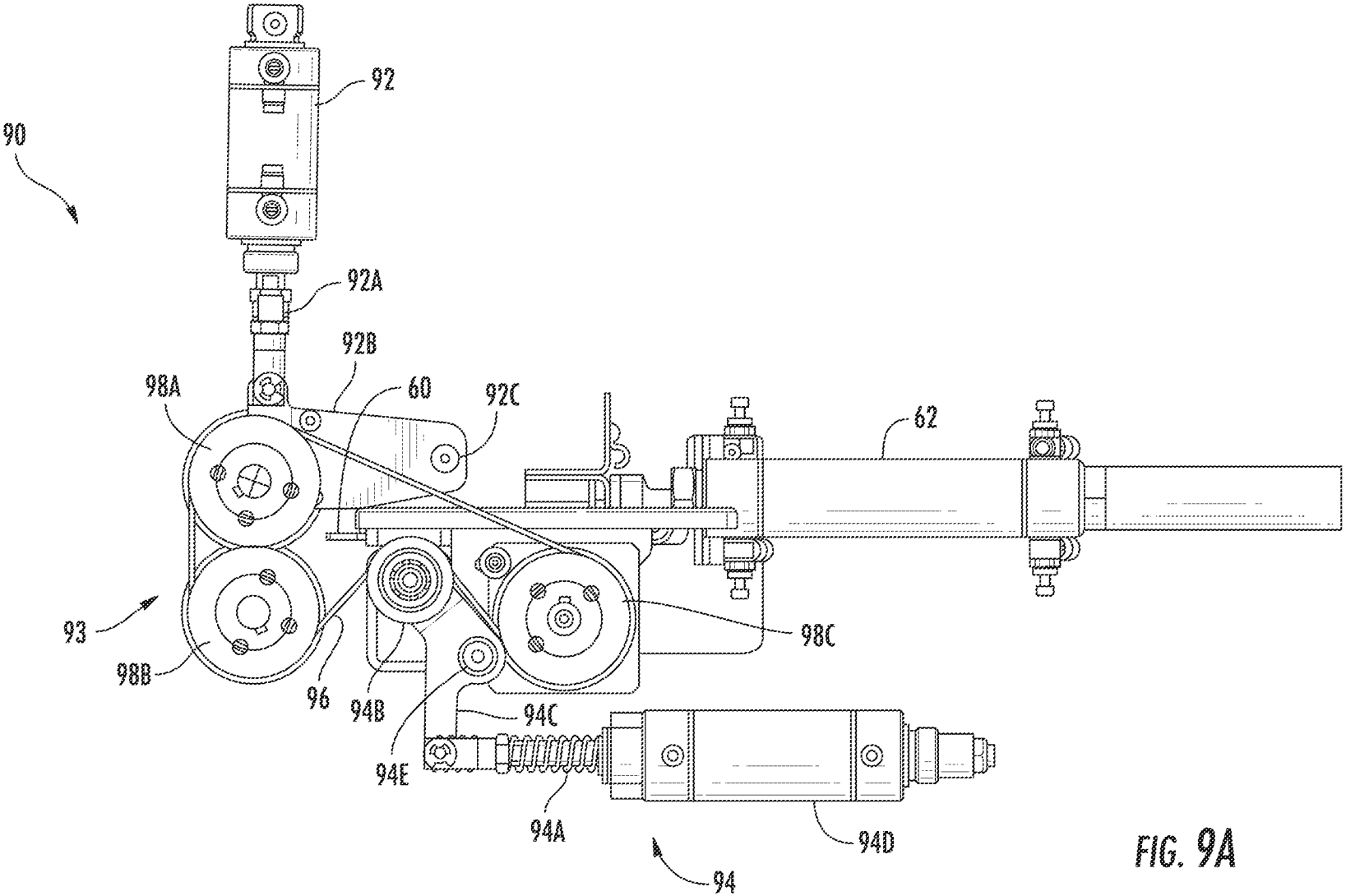
FIGS. 9A and 9B illustrate side perspective views of an embodiment of a set of back rollers and a welder in which an upper back roller can be raised for insertion of the welder into a winding zone in an embodiment of winding apparatus according to the present subject matter.
Figure 9B:
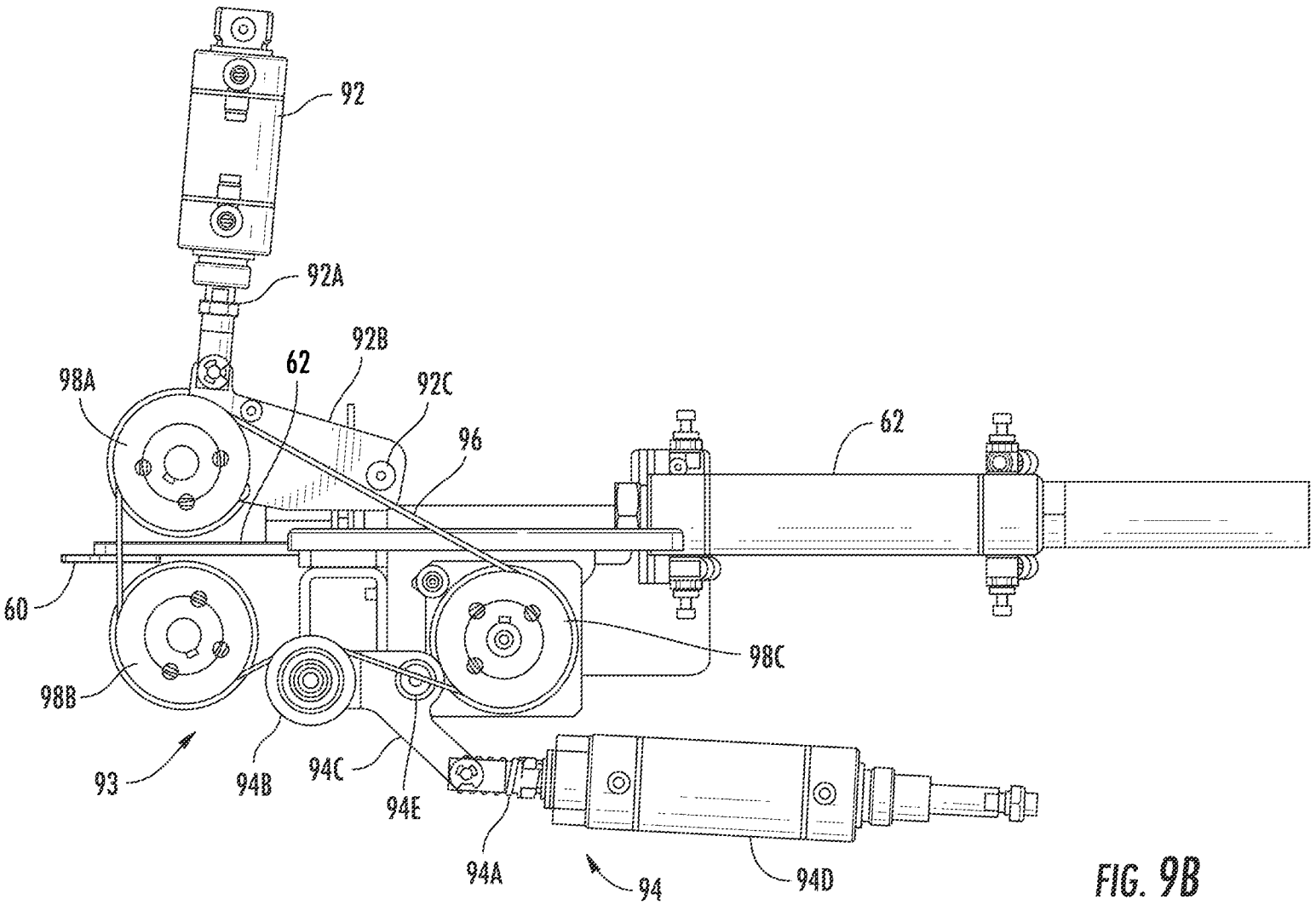

The upper back drive roller 14A can be controlled to raise and lower in different manners. For example, as shown in FIGS. 9A and 9B, an embodiment of a roller movement system, generally, 90 configured to raise and lower the upper back drive roller 14A relative to the lower back drive roller 14B and that can be secured to the carriage 20, such as on the roller frame 20C, can be provided. For example, the roller movement system 90 can comprise a drive roller lift 92 that is engages the upper back drive roller 14B that can raise and, in some embodiments, lower, the upper back drive roller 14A relative to the lower back drive roller 14B. For example, the drive roller lift 92 can comprise a hydraulic or pneumatic cylinder that can be controlled by the controller C. As shown, the drive roller lift 92 can have a lift arm 92A that engages the upper back drive roller 14B. In some embodiments, for example, the lift arm 92A can be secured to a pivot arm 92B that can engage the upper back drive rollers 14A at an end that is secured to the lift arm 92A and the pivot arm 92B can rotate about a pivot 92C which can secure the pivot arm 92B to the roller frame 20C at an opposite distal end of the pivot arm 92B from where the pivot arm 92B is secured to the upper back drive roller 14A.

In some embodiments, as shown, the roller movement system 90 can include a pulley and belt system 93 that can facilitate the lowering of the upper back drive roller 14B. The pulley and belt system 93 can comprise, a tensioner 94 that engages a belt 96 that is disposed about pulleys 98A, 98B, 98C. The pulley 98A can be secured to the upper back drive roller 14A and the pulley 98B can be secured to the lower back drive roller 14B. The tensioner 94 can engage the side of the belt 96 between either the lower back drive roller 14B or the upper back drive roller 14A to add tension to the belt. In some embodiments as shown, the tensioner 94 can comprise a driver 94D with a spring-loaded arm 94A that engages a rocker arm 94C on which a tension roller 94B resides that engages a side of the belt 96.

As shown in FIG. 9A, when the winding is occurring and the upper and lower back drive rollers 14A, 14B are in their winding position (see position of the upper and lower back drive rollers 14A, 14B in FIG. 3A-3E), the drive roller lift 92 is not engaged and the spring in the spring loaded arm 94A pushes the arm 94A outward and rotates the rocker arm 94C about a pivot 94E to push the tension roller 94B up against the belt 96 taking up slack in the belt 96 to keep it under tension. When it is time to raise the upper back drive roller 14A to allow the insertion of the welder 60 (or a labeler 70) that can be driven forward by a welder drive 62, the drive roller lift 92 pulls upward as shown in FIG. 9B such that the upper back drive roller 14A moves upward in the direction N to a position as shown in FIG. 3F. In such embodiments, as the lift arm 92A moves upward, the pivot arm 92B is pulled upward and rotates about the pivot 92C causing the upper back drive rollers 14A to be pulled upward. The pulling of the upper back drive roller 14A causes the pulley 98A associated with the upper back drive roller 14A to be raised. The increased distance between the pulley 98B associated with the lower back drive roller 14B and the pulley 98A associated with the upper back drive roller 14B causes the belt 96 to push downward on the tension roller 94B which causes the rocker arm 94C to rotate back around the pivot 94E to compress the spring on the spring-loaded arm 94A. As shown in FIG. 9B, by raising the upper back drive roller 14A a gap is provided into which the welder 60 can be inserted between the upper and lower back drive rollers 14A, 14B with a welder drive 62, the movement of which can be controlled by controller C. After the welding and/or labelling is performed, the welder 60 and/or labeler 70 can be retracted and the lift 92 can be released. The spring-loaded arm 94A can force the rocker arm 94C to rotate the tension roller 94A into the belt 96 to take up the slack in the belt 96 as the lift arm 92A is extended as the upper back drive roller 14A moves back to its position closer to lower back drive roller 14B as shown in FIG. 9A. In some embodiments, the lower back drive roller 14B can be lowered in a similar manner as the upper back drive roller 14A is raised as described above to create space for inserting either a welder 60 or a labeler 70. In some embodiments, both the upper back drive roller 14A can be raised and the lower back drive roller 14B can be lowered to create space for inserting either a welder 60 or a labeler 70.

In some such embodiments, after forming a terminal end TE of the roll of sheet material R, the roll of sheet material R can be rotated with the set of upper and lower front drive rollers 12A, 12B and upper and lower back drive rollers 14A, 14B so that the terminal end TE of the roll of sheet material R is positioned below the lower back drive roller 14B below the position of the welder 60. In this manner, the welder can form the weld above the terminal end TE and proximal to the terminal end TE to hold the terminal end TE to the roll of sheet material R.

Often, the sheet material SM being wound into a roll has preformed product section perforations PP as shown in FIG. 2C that allow the sheet material SM to be torn into individual sheets for easier use by the consumer. These preformed product section perforations PP can be run in the cross-direction CD and can be spaced apart at specified distances that best accommodate the intended use of the individual sheets. The distance between the preformed product section perforations PP can vary widely depending on the intended use of the sheets. In some embodiments, the preformed product section perforations PP can be about every 6 inches. In some embodiments, the preformed product section perforations PP can be about every 12 inches. In some embodiments, the preformed product section perforations PP can be about every 15 inches. In some embodiments, the preformed product section perforations PP can be about every 18 inches. In some embodiments, the preformed product section perforations PP can be about every 24 inches.

In such embodiments, where the sheet material SM has preformed product section perforations PP, the roll separation perforation SP can be a weaker perforation in the cross-machine direction CD than preformed product section perforations PP in the sheet material SM.

Figure 4:
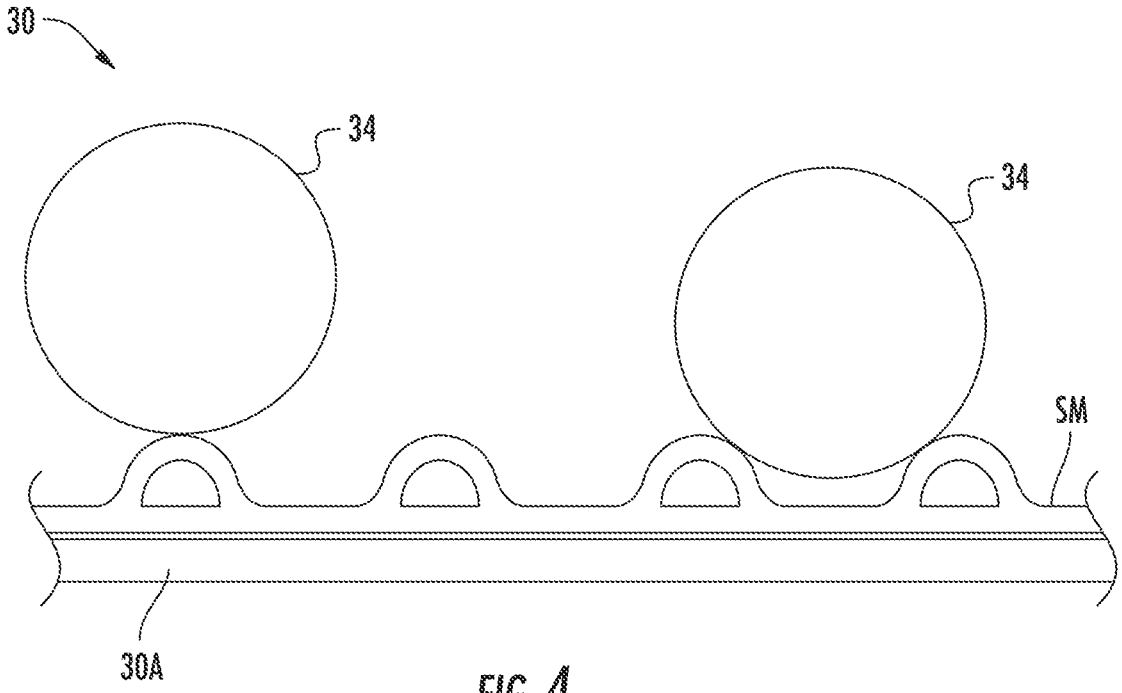
FIG. 4 illustrates a vertical cross-sectional side view of a portion of an embodiment of a feed system used to move sheet material along a travel path for an embodiment of a winding apparatus according to present subject matter in which the proportions of the sheet material are exaggerated to illustrate the interaction of the feed system with the sheet material.

Referring to FIG. 4, in embodiments where the sheet material SM is bubble wrap, the preservation of the bubbles in the sheet material SM is generally necessary for the intended end purpose of the sheet material SM. As shown in FIG. 4, the spacing between the bubbles of the bubble wrap are exaggerated to more easily illustrate the interaction of the bubble wrap sheet material SM with the feed nip rollers 34. For winding apparatuses winding rolls of bubble wrap, the feed nip rollers 34 can be weighted to a weight that holds the sheet material SM against the conveyor 30A so that the sheet material SM moves with the conveyor 30A, but, at the same time, allows bubbles formed in the sheet material SM to pass between the conveyor 30A and the nip rollers 34 without bursting the bubbles. In such embodiments, the feed nip rollers 34 are spaced apart in a manner such that, as the sheet material SM with bubbles formed thereon pass between the conveyor 30A and the feed nip rollers 34, the nip rollers 34 can move up and down as needed with the generally topography of the sheet material SM while generally staying in contact with at least a portion of the sheet material SM. In some embodiments, once the roll R of sheet material SM is formed and the winding rollers 11 are winding the roll R in the winding zone WZ, the feed nip rollers 34 can be lifted.

Figure 5:
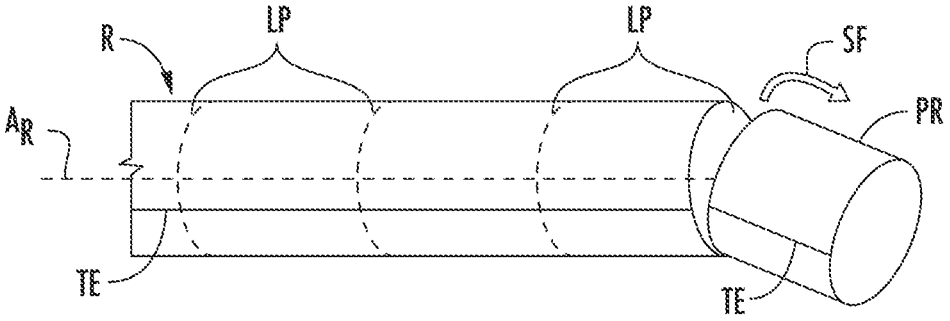
FIG. 5 illustrates a perspective view of an embodiment of a master coreless roll that was wound on an embodiment of a winding apparatus according to present subject matter.

In some embodiments, the winding apparatus 10 can additionally comprise at least one notched circular slitter blade 26 that is configured to rotate in the machine direction MD of the travel path TP and ride against a hard roll 28 as shown in FIGS. 2A and 2B and 3A-3F. The notched circular slitter blades 26 can create lengthwise perforations LP in the sheet material SM in the machine direction MD as shown in FIG. 2C. The notched circular slitter blades 26 create these lengthwise perforations LP in the sheet material SM before the sheet material SM enters the winding zone WZ between the set of the front drive rollers 12A, 12B and the back drive rollers 14A, 14B. Each notched circular slitter blade 26 can comprise a cutting-edge surface 26A around a circumference 26C of the blade 26 with one or more indentures 26B in the cutting-edge surface 26A to form isthmuses, or connecting tabs, CT of sheet material SM between the perforations LP formed by the cutting-edge surface 26A as shown in FIG. 2C. As the sheet material SM is moved with the winding drive rollers 12A, 12B, 14A, 14B and the conveyor 30 into the winding zone WZ between the set of the front drive rollers 12A, 12B and the back drive rollers 14A, 14B, the sheet material SM is perforated in the machine direction MD with at least one notched circular slitter blade 26 to create the lengthwise perforations LP that serve as product roll separation perforations in the sheet material SM that allow for the longer roll of sheet material R to be broken into consumer ready commercial small rolls of sheet material, or product rolls PR as shown in FIG. 5.

Alternatively, in some embodiments, continuous slitter blades or other slitting apparatuses, such as knife blades, (not shown) can be used to provide continuous slits in the machine direction MD before the sheet material SM is fed into the winding zone WZ. In this manner, the individual product rolls will already be formed upon winding without need of breaking the larger wound roll.

In particular, the sheet material SM with the product roll separation perforations LP therein is wound into a master roll R in the winding zone WZ as the set of the front drive rollers 12A, 12B and the back drive rollers 14A, 14B rotate and separate to widen the winding zone WZ as the master roll R enlarges such that the product roll separation perforations LP are about normal to an axis $A_R$ of the master roll R as shown in FIGS. 3C-3F and 5. Once the roll R has reached a desired cylindrical circumference and the sheet material SM being fed to the roll R is separated from the roll R, the master roll R can then be released from the winding zone WZ. If the master roll R is a coreless roll, the master roll R can be easily broken into product rolls PR. To create the product rolls PR from the master roll R, shear forces SF can be applied to the master roll of sheet material R to break the master roll R into product rolls PR of sheet material along the product roll perforations LP formed by the one or more notched circular slitter blades 26. For example, an operator can apply the shear force by hand to the master roll R to break it into the product rolls PR after the master roll R is dropped from the winding zone WZ.

Thereby, one or more notched circular slitter blades 26 can be configured to rotate in the machine direction MD in the travel path TP to create a lengthwise perforation LP in the sheet material SM in the machine direction MD before the sheet material SM enters the winding zone WZ between the set of the front drive rollers 12A, 12B and the back drive rollers 14A, 14B. Each notched circular slitter blade 26 can comprising a cutting edge surface 26A around a circumference 26C of the blade 26 with one or more indentures 26B in the cutting edge surface 26A to form isthmuses, or connecting tabs, CT in sheet material SM between perforations LP formed by the cutting edge surface 26A that allow the roll of sheet material 26 wound in the winding zone WZ between set of front drive rollers 12A, 12B and back drive rollers 14A, 14B to be separated into smaller product rolls of the sheet material PR upon application of a force to the roll of sheet material R.

Figure 6:
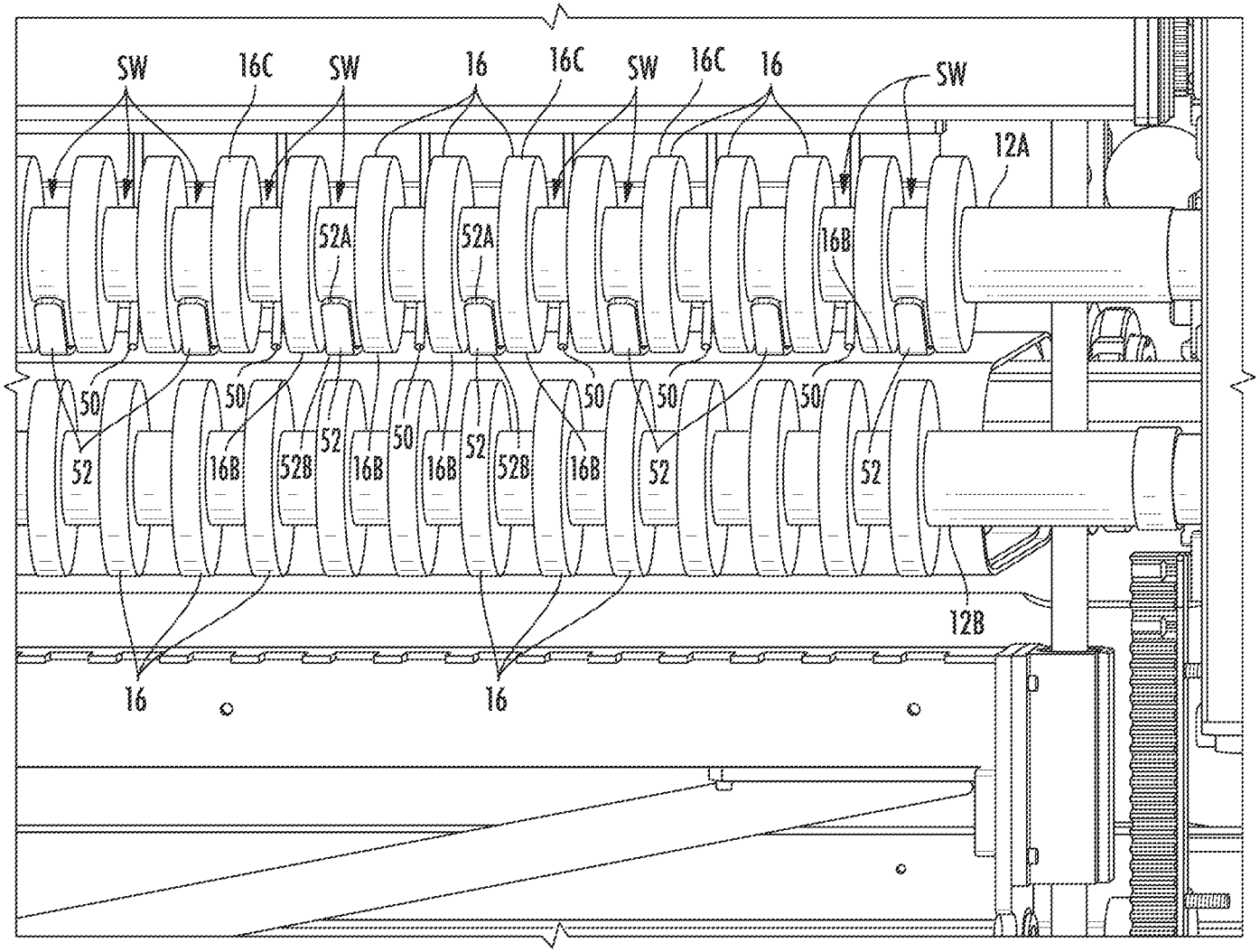
FIG. 6 illustrates a partial perspective view of a portion of a winding apparatus showing upper and lower front drive rollers used to wind sheet material into a roll according to the present subject matter.
Figure 7A:
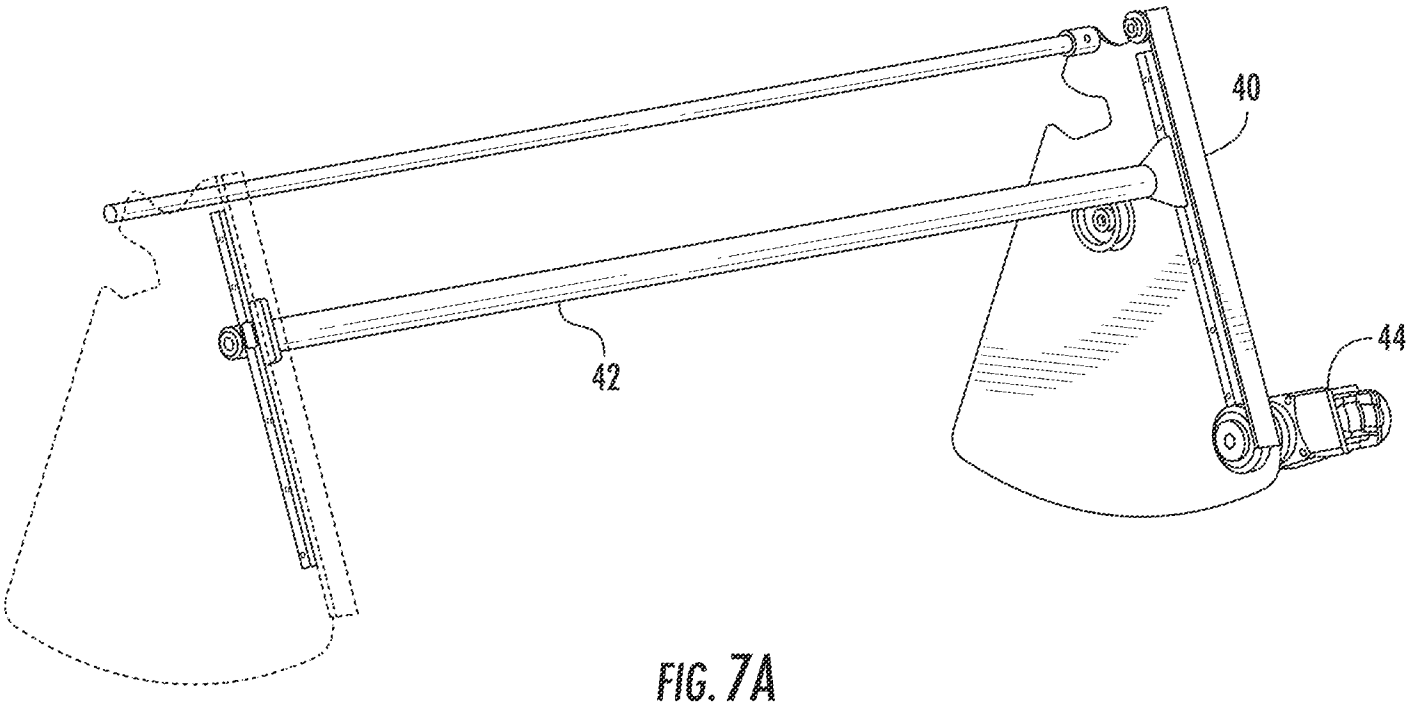
FIG. 7A illustrates perspective view of an embodiment of a support cradle for supporting a roll of sheet material (not shown) formed in an embodiment of a winding apparatus according to the present subject matter.
Figure 7B:
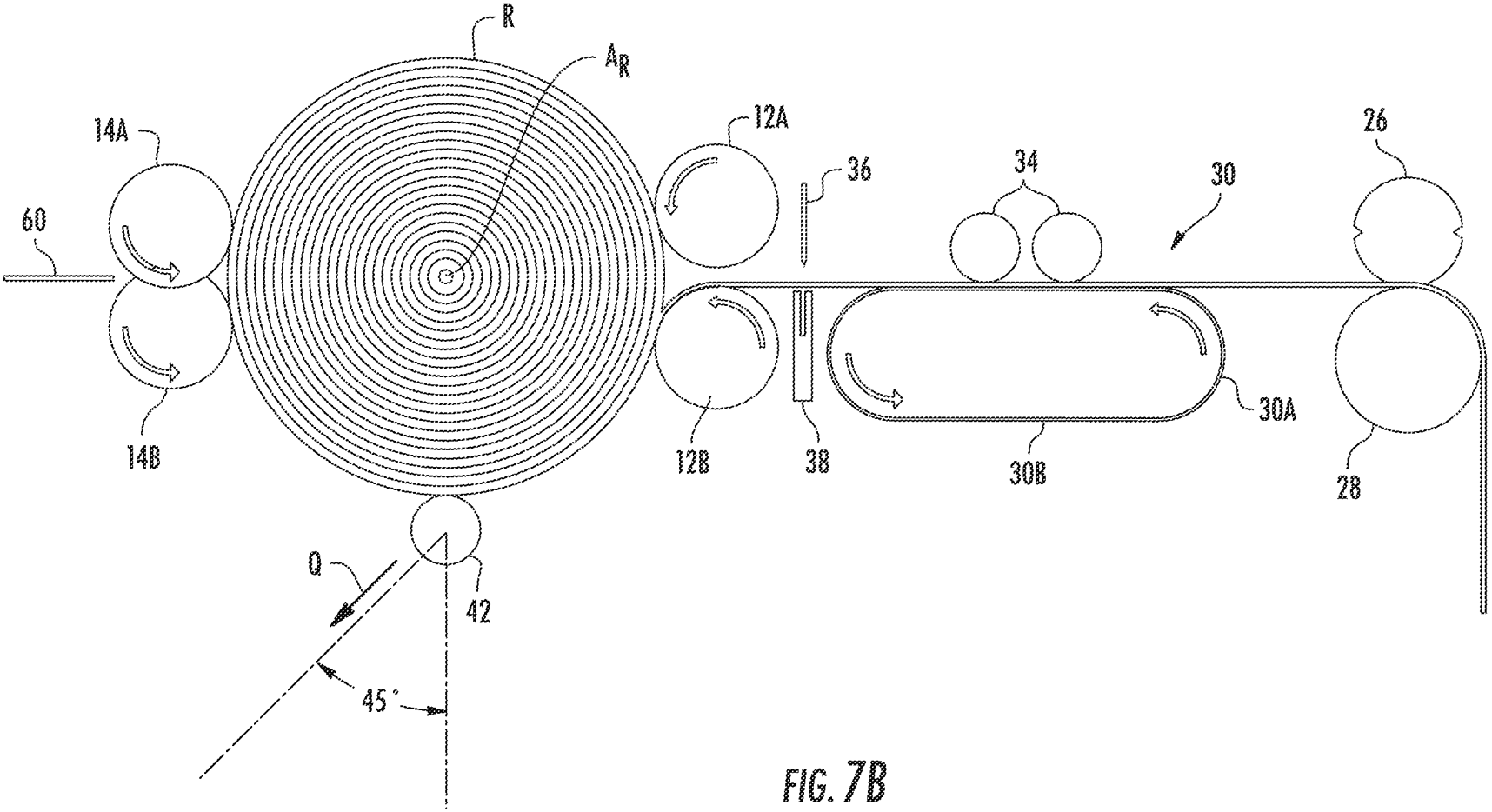
FIG. 7B illustrates a schematic side view of an embodiment of a winding apparatus using an embodiment of a support cradle according to the present subject matter.

In some embodiments, the beginning of the formation of the roll R can be critical. Due to the fact that front drive rollers 12A, 12B need to be spaced apart to allow entry of the sheet material SM into the winding zone WZ, an issue of the start end SE of the sheet material SM rotating out of the winding zone WZ can occur. When the start end SE of the sheet material SM in the winding zone WZ starts to rotate as the front drive rollers 12A, 12B and back drive rollers 14A, 14B are rotating as shown in FIG. 3B, the start end SE of the sheet material SM can have a tendency to catch a bottom 16B of the wheels 16 of the upper front drive roller 12A causing the start end SE of the sheet material SM to roll out of the winding zone WZ. To minimize this issue, as shown in FIGS. 2A, 2B and 6, the winding apparatus 10 can comprise air tubes 50 positioned periodically in the spaces SW between the drive wheels 16 of the upper front drive rollers 12A. The air tubes 50 can be angled to blow air into the winding zone WZ proximal to the area of the wheels 16 where the start end SE of the sheet material SM is prone to catch to prevent the catching of a start end SE of the sheet material SM by the wheels 16 of the upper front roll 12A in a manner that would cause the start end SE to exit between the upper and lower front drive rollers 12A, 12B during the beginning formation of the roll of sheet material R. Additionally, winding apparatus 10 can comprise fingers 52 positioned in at least some of the spaces SW between the drive wheels 16 of the upper front drive rollers 12A not occupied by the air tubes 50. For example, as in the embodiment shown in FIG. 6, the fingers 52 can be positioned in the spaces SW between the drive wheels 16 of the upper front drive roller 12A not occupied by the air tubes 50. The fingers 52 can be angled to cause the start end SE of the sheet material to roll forward onto the incoming sheet material SM in the winding zone WZ to form the axis $A_R$ of the roll of the sheet material R. For example, the fingers 52 can be configured to have some portion 52B that can extend outward beyond the drive wheels 16 to remove contact of the sheet material SM with the drive wheels 16 of upper front drive roller 12A to aid in preventing the drive wheels from pulling the start end SE out of the winding zone WZ.

In some embodiments, for instance, the fingers 52 can extend on an entry side 16A of the drive wheels 16 of the upper front drive rollers 12A as shown in FIGS. 2A and 2B and extend in some of the spaces SW between the wheels 16 on an underside 16B of the wheels 16 such that a portion 52B of the fingers 52 extend below the underside 16B of the drive wheels 16. In some such embodiments, the portion 52B of the fingers 52 is the only part of the fingers 52 that extends outside circumferences 16C of the drive wheels 16 in a position to contact the sheet material SM. For example, the fingers 52 can be angled in a manner such that ends 52A of the fingers 52 point upward within the circumference 16C of the drive wheels 16 toward the winding zone WZ extend beyond the circumference 16C of the drive wheels 16 of the upper front drive rollers 12A.

The air tubes 50 can receive air from an air supply 54, such as a pneumatic system that supplies air, as shown in FIGS. 1C and 1D. The air supply can be in communication with the controller C to control when air is supplied to the air tubes 50. The air tubes 50 can be used to ensure that the start end SE of the sheet material SM properly starts the roll R. For example, once a start end SE of sheet material SM is within the winding zone WZ between the set of the front drive rollers 12A, 12B and the back drive rollers 14A, 14B. The air tubes 50 can blow air into the winding zone WZ to prevent the catching of a start end SE of the sheet material SM by the wheels 16 of the upper front roll 12A in a manner that would cause the start end SE to exit between the upper and lower front drive rollers 12A, 12B during the beginning formation of the roll of sheet material R. Once started, the sheet material SM is then wound into the roll of sheet material R in the winding zone WZ as the set of the front drive rollers 12A, 12B and the back drive rollers 14A, 14B rotate and separate to widen the winding zone WZ as the roll of sheet material R grows.

It is noted that the air tubes 50 and fingers 52 are shown and discussed in separate and/or alternating spaces SW between the wheels 16. In some embodiments, however, air tubes and fingers can be in the same space SW between wheels 16 as shown in FIG. 1C. It is also noted that the air tubes 50 and fingers 52 are shown between the wheels 16 of the upper front drive rollers 12A. However, if the rotation of the front drive rollers 12A, 12B and back drive rollers 14A, 14B is reversed from the counterclockwise rotation in direction K to a clockwise rotation in the opposing direction, then the fingers and air tubes could be oriented between the wheels 16 of the lower front drive rollers 12B around the top portion of the wheels 16, such that the air tubes 50 would blow air upward into the winding zone WZ. The change in positioned of the air tubes 50 and fingers 52 would better facilitate the preventing of the start end SE of the sheet material SM from rolling out of the winding zone WZ, since the start end SE of the sheet material SM would roll downward and underneath to form the axis $A_R$ and start the roll R. Thus, placement and orientation of the air tubes 50 and fingers 52 can depend on the direction of rotation of the front drive rollers 12A, 12B and back drive rollers 14A, 14B for winding the sheet material SM into a roll R.

As stated above, the tender perforator 36 can perforate the sheet material SM in the cross-machine direction to create a roll separation perforation SP in the sheet material SM for the roll R of sheet material SM and breaking the roll separation perforation SP before releasing the roll R from the winding zone to form a terminal end TE of the roll R that has been formed in the winding zone WZ and a start end SE of a new roll to be formed in the winding zone WZ. By using the air tubes 50 and fingers 52 as described above along with forming the start end SE in the winding zone WZ, jamming of the winding apparatus 10, particularly in the winding zone WZ, can be reduced or eliminated. The handling of a start end SE of a roll is where a majority of jamming of a winding apparatus 10 occurs. By starting a roll with the start end SE sheet material SM already within the winding zone WZ, problems caused by getting the start end SE of the sheet material SM into the winding zone WZ are eliminated. Further, another major cause of jamming of a winding apparatus is the start end SE being pulled out of the winding zone WZ at the beginning of a roll. Through the use of the air tubes 50 and fingers 52, the start end SE of the sheet material SM can be kept in the winding zone at the beginning of the formation of a roll. Thereby, two of the major causes of jamming of a winding apparatus can be greatly reduced or eliminated.

In some embodiments, instead of or in addition to the welder 60, the winding apparatus 10 can also comprise a labeler 70 as shown in FIG. 2A. As stated above, to form the terminal end TE, the sheet material SM can be perforated in the cross-machine direction CD with the tender perforator 36 to create a roll separation perforation SP in the sheet material SM for the roll of sheet material R. The feed system 30 can comprise a tractor drive conveyor 30A having a belt 30B on which the sheet material SM resides and floating nip rollers 34 that aid in transferring the sheet material SM to the winding zone WZ between the front drive rollers 12A, 12B and the back drive rollers 14A, 14B. To form the terminal end TE, the rotation of the conveyor 30A and nip rollers 34 can be stopped once the separation perforation SP in the sheet material SM is in the winding zone WZ. The set of the front drive rollers 12A, 12B and the back drive rollers 14A, 14B can continue to rotate causing the roll separation perforation SP in the sheet material SM to break to separate the roll R from the unrolled sheet material SM that is in the winding zone WZ.

In some embodiments, the labeler 70 can be positioned after the upper and lower back drive rollers 14A, 14B for insertion between the upper and lower back drive rollers 14A, 14B to apply a label to the terminal end TE of the sheet material SM and a portion of the roll of sheet material R. Alternatively, labeler 70 can be used to tape the terminal end TE of the sheet material SM to the terminal end TE to the roll R to hold the terminal end TE to the roll R without the use of the welder 60.

When using the labeler 70, the feed system 30 can move the sheet material SM into the winding zone WZ between the set of the front drive rollers 12A, 12B and the back drive rollers 14A, 14B, where the sheet material SM can be wound into the roll R in the winding zone WZ as the set of the front drive rollers 12A, 12B and the back drive rollers 14A, 14B rotate and separate to widen the winding zone WZ as the roll R grows. As with the welder 60, after the roll of sheet material R reaches a desired size, a terminal end TE of sheet material SM in the roll R can be formed as described above. For example, tender perforator can be used to create a separation perforation SP in the sheet material as described above. The rotation of the feed system 30 can be stopped once the separation perforation SP in the sheet material SM is in the winding zone WZ, while the set of the front drive rollers 12A, 12B and the back drive rollers 14A, 14B continue to rotate causing the roll separation perforation SP in the sheet material SM to break to separate the roll of sheet material R from the sheet material SM in the winding zone.

The terminal end TE of the sheet material SM in the roll R can then be rotated in the winding zone WZ by rotating the front drive rollers 12A, 12B and the back drive rollers 14A, 14B to position the terminal end TE proximal to the back drive rollers 14A, 14B. For example, the terminal end TE can be rotated to a position proximate to and below the lower back drive rollers 14B. The upper back drive rollers 14A can be raised upward while keeping the upper back drive roller 14A in contact with a circumference CR of the roll of sheet material R to create space between the upper back drive rollers 14A and the lower back drive rollers 14B. The labeler 70 can be inserted between the upper and lower back drive rollers 14A, 14B to apply a label to a terminal end TE of the sheet material SM and a portion of the roll of sheet material R to hold the terminal end TE to the roll R. In some embodiments, to properly align the terminal end TE with the labeler 70, the roll of sheet material R can be rotated with the set of upper and lower front drive rollers 12A, 12B and upper and lower back drive rollers 14A, 14B so that the terminal end TE of the roll of sheet material R is positioned below the lower back drive roller 14B. At this position, the terminal end TE is aligned with the position of the labeler 70, such that the labeler 70 can partially apply a label to the circumference CR of the roll R above the terminal end TE. As the roll R is at least partially rotated after the label is partially adhered to the circumference CR of the roll R, the upper back drive roller 14A can press the rest of the label not yet applied over the terminal end TE to hold the terminal end TE to the roll of sheet material R.

Thereby, a labeler 70 can be provided in place of a welder 60 that can be positioned after the upper and lower back drive rollers 14A, 14B. The labeler 70 can be inserted between the upper and lower back drive rollers 14A, 14B to apply a label to a terminal end TE of the sheet material SM and a portion of the roll of sheet material R to hold the terminal end TE to the roll of sheet material SM. To permit the insertion of the labeler 70, the upper back drive roller 14A can be moved upward while staying in contact with the circumference CR of the roll of sheet material R to create space between the upper back drive roller 14A and the lower back drive roller 14B for insertion of the labeler 70.

Referring to FIGS. 1A, 2B, 7A and 7B, in some embodiments, as the roll of sheet material R grows on the winding apparatus 10, it can be beneficial to provide support to the roll R to support the weight and prevent sagging. For example, as mentioned above, the winding apparatus 10 can comprise a support cradle 40 comprising a support roller 42 that extends transverse to the travel path TP of the sheet material SM and can be about parallel to the set of front drive rollers 12A, 12B and back drive rollers 14A, 14B. The support cradle 40 can be rotatable between a support position and a release position using an air cylinder, for example. In particular, the support cradle 40 can rotate outward to a support position and can move the support roller 42 downward in a direction Q such that the support roller 42 is positioned under the roll of sheet material R being wound. The support roller 42 provides support to the roll of sheet material R as it grows. In some embodiments, the support roller 42 can move downward at about a 45° angle to stay in contact with the roll of sheet material R. By staying in contact with the roll of sheet material R as the roll of sheet material R grows, the support roller 42 can provide the necessary support to the roll R to keep it in the winding zone WZ as the weight of the roll R increases. Once the roll R reaches a desired diameter, the air cylinder can be activated to rotate the support cradle 40 inward to the release position removing the support roller 42 and the support cradle 40 from the support position removing the support for the roll R allowing the roll R to be released from the winding zone WZ.

Additionally, in some embodiments, by moving downward at about a 45° angle as the roll grows, the support roller 42 can stay in a position underneath the axis $A_R$ of the roll of the sheet material R to provide the extra support. While the support roller 42 may be in contact with the roll of sheet material R at positions other than directly beneath the axis $A_R$ of the roll of the sheet material R to provide support, by keeping the support roller 42 beneath the axis $A_R$ of the roll of the sheet material R, then support may be provided with less compression of the roll of sheet material R. As stated above, the support cradle 40 can be controlled by an air cylinder, while a support roller servo motor 44 can be provided to control the movement of the support roller 42. For example, the support roller servo motor 44 can control the movement of the support roller 42 so that the support roller 42 comes in contact with the roll of sheet material R and moves downward at about a 45° angle to stay in contact with the roll of sheet material R for support as the roll of sheet material R grows.

These and other modifications and variations to the present subject matter may be practiced by those of ordinary skill in the art, without departing from the spirit and scope of the present subject matter, which is more particularly set forth herein above and any appending claims. In addition, it should be understood the aspects of the various embodiments may be interchanged both in whole or in part. Furthermore, those of ordinary skill in the art will appreciate that the foregoing description is by way of example only, and is not intended to limit the present subject matter. Any reference signs incorporated in the claims are solely to ease their understanding, and do not limit the scope of the claims.

What is claimed is:

1. A method of forming product rolls of sheet material using a coreless winding apparatus, the method comprising the steps of:

providing a winding apparatus comprising:

a set of upper and lower front drive rollers and at least one back drive roller, each drive roller of the upper and lower front drive rollers and the at least one back drive roller comprising drive wheels spaced apart along the respective drive roller with a winding zone between the front drive rollers and the at least one back drive roller to wind the sheet material into a roll of sheet material;

a feed system positioned before the set of the front drive rollers and the at least one back drive roller for moving the sheet material along a travel path in a machine direction into the winding zone between the set of the front drive rollers and the at least one back drive roller; and air tubes positioned periodically in the spaces between the drive wheels of at least one of the upper front drive roller or the lower front drive roller, the air tubes angled to blow air into the winding zone;

moving a start end of sheet material with the feed system into the winding zone between the set of the front drive rollers and the at least one back drive roller;

blowing air into the winding zone to prevent the catching of a start end of the sheet material by the wheels of the front drive rollers in a manner that would cause the start end to exit between the upper and lower front drive rollers during the beginning formation of the roll of sheet material; and winding the sheet material into the roll of sheet material in the winding zone as the set of the front drive rollers and the at least one back drive roller rotate and separate to widen the winding zone as the roll of sheet material grows.

2. A winding apparatus comprising:

a set of upper and lower front drive rollers and at least one back drive roller, each drive roller of the upper and lower front drive rollers and the at least one back drive roller comprising drive wheels spaced apart along the respective drive roller with a winding zone between the front drive rollers and the at least one back drive roller to wind the sheet material into a roll of sheet material;

a feed system positioned before the set of the front drive rollers and the at least one back drive roller for moving sheet material along a travel path in a machine direction into the winding zone between the set of the front drive rollers and the at least one back drive roller; and air tubes positioned in the spaces between the drive wheels of at least one of the upper front drive roller or the lower front drive roller, the air tubes configured to blow air into the winding zone to prevent the catching of a start end of the sheet material by the wheels of the front drive rollers in a manner that would cause the start end to exit between the upper and lower front drive rollers during the beginning formation of the roll of sheet material.

3. The winding apparatus according to claim 2, further comprising fingers positioned in the spaces between the drive wheels of at least one of the upper front drive roller or the lower front drive roller not occupied by the air tubes, the fingers being angled to cause the start end of the sheet material to roll forward in the winding zone to form an axis of the roll of the sheet material by removing contact of the sheet material with the drive wheels of the at least one of upper front drive roller or lower front drive roller to aid in preventing the drive wheels from pulling the start end out of the winding zone.

4. The winding apparatus according to claim 3, wherein the fingers extend on an entry side of the drive wheels of the upper front drive rollers and extend in the spaces between the wheels on an underside of the wheels such that a portion of the fingers extend below the underside of the drive wheels.

5. The winding apparatus according to claim 4, wherein the fingers are angled in a manner that ends of the fingers do not extend beyond a circumference of the drive wheels of the upper front drive rollers.

6. The winding apparatus according to claim 4, wherein the fingers and the air tubes are positioned in alternating spaces between the drive wheels of the upper front drive roller.

7. The coreless winding apparatus according to claim 2, wherein the air tubes are angled to blow air at an angle into the winding zone to facilitate the start end of the sheet material to rotate in on the sheet material during the beginning formation of the roll of sheet material.

8. The winding apparatus according to claim 2, further comprises a tender perforator positioned before the winding drive rollers for perforating the sheet material in a cross-machine direction when a roll of sheet material has been wound in the winding zone to create a roll separation perforation.

* * * * *